US006961037B2

(12) United States Patent
Kuwata et al.

(10) Patent No.: US 6,961,037 B2
(45) Date of Patent: Nov. 1, 2005

(54) PROCESSING OF IMAGE DATA SUPPLIED TO IMAGE DISPLAY APPARATUS

(75) Inventors: Naoki Kuwata, Nagano-ken (JP); Hirokazu Ishida, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 650 days.

(21) Appl. No.: 09/864,308

(22) Filed: May 25, 2001

(65) Prior Publication Data

US 2002/0044122 A1 Apr. 18, 2002

(30) Foreign Application Priority Data

May 25, 2000 (JP) ..... 2000-154034
Apr. 4, 2001 (JP) ..... 2001-105425

(51) Int. Cl.[7] ..... G09G 3/36
(52) U.S. Cl. ..... 345/88; 345/600
(58) Field of Search ..... 345/87–102, 589–605; 382/162, 167, 163; G09G 3/36

(56) References Cited

U.S. PATENT DOCUMENTS 5,673,065 A * 9/1997 DeLeeuw ..... 345/605
5,852,430 A * 12/1998 Endo ..... 345/101
6,031,641 A * 2/2000 Hoshino ..... 358/521
6,097,836 A * 8/2000 Inoue ..... 382/165
6,300,931 B1 * 10/2001 Someya et al. ..... 345/102
6,304,671 B1 * 10/2001 Kakutani ..... 382/167
6,346,994 B1 * 2/2002 Inoue ..... 358/1.9
6,714,204 B2 * 3/2004 Ishida et al. ..... 345/522
6,717,696 B1 * 4/2004 Wang et al. ..... 358/1.9
2002/0059460 A1 * 5/2002 Ishida et al. ..... 709/246

FOREIGN PATENT DOCUMENTS

JP 06006733 A * 1/1994 ..... H04N 5/66
JP 10313418 A * 11/1998 ..... H04N 5/202
JP 11-187265 7/1999
KR 1999-0037149 5/1999

* cited by examiner

*Primary Examiner*—Alexander Eisen
(74) *Attorney, Agent, or Firm*—Oblon, Spivak, McClelland, Maier & Neustadt, P.C.

(57) ABSTRACT

The technique of the present invention carries out image processing of image data, which are to be supplied to an image display apparatus having a less number of expressible tones than a number of tones included in original image data and a non-linear display characteristic. The procedure of the present invention takes into account the non-linear display characteristic of the image display apparatus and corrects a tone value with regard to each pixel with a look-up table, so as to enhance a tone distribution corresponding to an area of wide intervals of output lightness, while reducing a tone distribution corresponding to an area of narrow intervals of the output lightness. The procedure then carries out a dispersion-type halftoning process for color reduction to convert the corrected tone values to display tone values expressible by the image display apparatus. A plurality of lookup tables is provided corresponding to a plurality of settings for a predetermined condition, such as environmental temperature, affecting the display characteristic of the image display apparatus. The selected lookup table is changeable according to a current setting of the predetermined condition. This technique of the present invention effectively improves the picture quality of resulting displayed images on the image display apparatus.

26 Claims, 22 Drawing Sheets

Fig. 3

| PALLET INDEX COLORS | ( R , G , B ) |
|---|---|
| 0 | ( 255 , 255 , 255 ) |
| 1 | ( 232 , 100 , 140 ) |
| 2 | ( 221 , 255 , 30 ) |
| 3 | ( 180 , 75 , 0 ) |
| ⋮ | ⋮ |
| 252 | ( 0 , 97 , 156 ) |
| 253 | ( 0 , 30 , 170 ) |
| 254 | ( 0 , 0 , 85 ) |
| 255 | ( 0 , 0 , 0 ) |

Fig. 5

LUT for R

| DXR | DXr |
|---|---|
| 0 | 0 |
| ⋮ | ⋮ |
| 64 | 80 |
| ⋮ | ⋮ |
| 104 | 104 |
| ⋮ | ⋮ |
| 184 | 152 |
| ⋮ | ⋮ |
| 255 | 255 |

V1on/V1off = V2on/V2off = fixed

PROCESSING OF IMAGE DATA SUPPLIED TO IMAGE DISPLAY APPARATUS

BACKGROUND OF THE INVENTION

1. Field of the Invention

The present invention relates to a technique of processing image data supplied to an image display apparatus.

2. Description of the Related Art

A liquid crystal display (LCD) panel is generally used for an image display of cellular phones. The LCD panel switches on and off the driving voltage applied to liquid crystal cells arranged in a matrix, so as to vary the transmission of the liquid crystal and display two-tone images, such as letters, characters, and pictures. The cellular phones have been advanced significantly to attain multiple functions, and some models are accessible to the Internet. With such advance, the multiple tone expression is required for the LCD panel of the cellular phones to allow display of many pieces of information. A color LCD panel has been applied for the cellular phones to enable multiple tone expression of color images.

Image data read with an input device, such as a scanner or a digital camera, and image data designed on the computer are generally RGB data (8 bits for each of R, G, and B and 256 tones in total). The LCD panel mounted on the cellular phone has a less number of expressible tones in each cell than the number of tones included in original image data. Color reduction is accordingly carried out. It is assumed here that the LCD panel provides expression of eight tones. FIG. 20 shows a mapping of 256 tones of image data to 8 tones. The procedure equally divides the 256 tones of image data into 8 divisions and successively allocates the tone values in each division to each "display tone value" expressible by the LCD panel. This accomplishes color reduction from 256 tones to 8 tones. For example, the pixels having the input tone value of 190 are unequivocally mapped to the display tone value of 5. This method is called 'simple color reduction'.

The multiple tone expression on the LCD panel may be attained by stepwise setting the effective driving voltage applied to liquid crystal cells and stepwise regulating the transmittance of the liquid crystal. There are two known settings for the driving voltage of the LCD panel. FIGS. 21A and 21B show voltage-transmittance characteristics (V-T characteristics) of the LCD panel, that is, the transmittance of the liquid crystal against the effective driving voltage.

The first setting has the transmittance at equal intervals as shown in FIG. 21A. As is known to those skilled in the art, the LCD panel has non-linear V-T characteristics. The technique thus regulates the effective driving voltage to equalize the intervals of the transmittance by taking advantage of the pulse width modulation. The effective driving voltage corresponds to the display tone value expressible by the LCD panel, so that the display tone value and the output lightness hold a linear relationship.

The second setting has the effective driving voltage at equal intervals as shown in FIG. 21B. One picture screen consists of a plurality of frames. The technique controls ON and OFF the driving voltage with regard to each pixel frame by frame to allow multiple tone expression. This setting, however, causes a variation in interval of the transmittance, that is, a variation in interval of the lightness expressible by the LCD panel. The display tone value expressible by the LCD panel and the output lightness accordingly have a non-linear relationship. For example, when the LCD panel is driven in the range of the effective driving voltage shown in FIG. 21B, the expressible lightness has wide intervals in an intermediate tone region, while having narrow intervals in both a low tone region and a high tone region.

By taking into account the color reproducibility, the LCD panel of the pulse width modulation type has mainly been applied for the cellular phones.

The pulse width modulation, however, has a large rate of power consumption. From the viewpoints of the extended life of the battery and energy saving, such large power consumption is serious problem in cellular phones having small battery capacities. The Frame Rate Control (FRC) with a smaller rate of power consumption has thus also been applied for the cellular phones.

As discussed previously, the Frame Rate Control (FRC) has non-linear display characteristics and suffers significant deterioration of the picture quality due to that. The deterioration of picture quality is especially remarkable in natural images that have a large percentage of image data in the intermediate tone region. For example, in the case of displaying an image of 'sky' or 'flesh' having continuously varying tone values, the pixels of identical lightness (display tone value) collectively appear in a specific area where pixels adjoining to each other in the original image data have close tone values. Even a one-step difference in display tone value leads to a significant difference in lightness. The false-contour thus appears on the boundary between pixels of different display tone values. It is difficult to improve such deterioration of the picture quality by the hardware configuration.

A liquid crystal display apparatus with the LCD panel generally has an electronic volume for adjusting the display contrast. The electronic volume is individually adjusted to maximize the display contrast of the LCD panel. FIG. 22 is a graph showing adjustment of the display contrast of the LCD panel with the electronic volume. For example, at the setting of the electronic volume equal to '1', the voltages at the ON state and the OFF state of the driving voltage of the LCD panel are respectively V1on and V1off. The transmittances are T1on and T1off. At the setting of the electronic volume equal to '2', the voltages at the ON state and the OFF state of the driving voltage of the LCD panel are respectively V2on and V2off. The transmittance are T2on and T2off. There is a relationship of V1on/V1off=V2on/V2off= fixed. T1on-T1off or T2on-T2off corresponds to the contrast.

The contrast of the LCD panel varies according to the working environments (temperature and brightness) and the settings (ON-OFF state of the backlight). For example, the temperature characteristic of the LCD panel affects the contrast thereof. At low environmental temperatures, the transmittance of the LCD panel is lowered to reduce the contrast. At high environmental temperatures, on the contrary, the transimittance of the LCD panel is raised to enhance the contrast. Such a variation in contrast may deteriorate the picture quality of the resulting displayed images.

SUMMARY OF THE INVENTION

The object of the present invention is thus to provide a technique that carries out image processing of image data, which are to be supplied to an image display apparatus having a less number of expressible tones than the number of tones included in original image data, thus improving picture quality of resulting displayed images.

At least part of the above and the other related objects is attained by a first image processing apparatus that carries out predetermined image processing of image data, which are to be displayed on an image display apparatus, and thereby generates supplied data to the image display apparatus. The image display apparatus is a liquid crystal display apparatus that provides frame rate control-type tone display and has a less number of expressible display tones with regard to each pixel than a number of tones in the image data. The first image processing apparatus includes: an input unit that inputs the image data; and a color reduction process unit that sets a display tone value, which is expressible by the liquid crystal display apparatus, with regard to each pixel, based on tone values of the image data. The color reduction process unit performs the setting to make a range of the tone values allocated to each display tone value in at least either one of a high tone region and a low tone region narrower than that in an intermediate tone region.

As discussed previously, the prior art color reduction process divides the tone values of the input image data at equal intervals and allocates the respective divisions to display tone values expressible by the image display apparatus. In the case of an image display apparatus that has a linear display characteristic and gives the output lightness against the display tone value at equal intervals, this prior art technique ensures ideal tone expression of good color balance. In the case of an image processing apparatus that provides frame rate control-type tone display, which has a non-linear display characteristic, the prior art technique does not ensure the ideal tone expression, because of the bias of the output lightness. The setting of the electronic volume shown in FIG. 22 narrows the interval of expressible lightness in at least one of a low tone region and a high tone region, compared with the interval of lightness in an intermediate tone region. In the arrangement of the present invention, on the other hand, the color reduction process unit sets the display tone values, such that a range of the tone values allocated to each display tone value in at least either one of a high tone region and a low tone region is made narrower than that in an intermediate tone region. This enables an approach to ideal tone expression. It is preferable that the setting of the display tone values has varying intervals, which are identical with the varying intervals of the lightness output against the display tone value by the image display apparatus.

The present invention is also directed to a second image processing apparatus that carries out predetermined image processing of image data, which are to be displayed on an image display apparatus, and generates supplied data to the image display apparatus, and has a non-linear display characteristic in which the number of expressible tones for each pixel is fewer than that of the image data and the output lightness to the display tone value is provided at varying intervals. The second image processing apparatus includes: an image data correction unit that carries out tone correction by taking into account the non-linear display characteristic to enhance a tone distribution corresponding to an area of wide intervals, while reducing a tone distribution corresponding to an area of narrow intervals in a tone distribution of input image data; and a color reduction process unit that divides a range of the tone correction into a preset number of divisions and allocates tone corrected values in each division to each display tone value according to a predetermined rule, so as to implement color reduction.

The second image processing apparatus of the present invention takes into account the non-linear display characteristic of the image display apparatus and carries out above mentioned tone correction to enhance a tone distribution corresponding to an area of wide intervals, while reducing a tone distribution corresponding to an area of narrow intervals in a tone distribution of the input image data. The second image processing apparatus then carries out color reduction to allocate corrected values in each division to each display tone value according to a predetermined rule. Here the expression 'to enhance the tone distribution' means to increase the number of pixels having tones values in a predetermined region. The expression 'to reduce the tone distribution' means to decrease the number of pixels having tone values in a predetermined region.

Such image processing is equivalent to a process of changing the range of the input tone values allocated to each display tone value. This ensures an approach to ideal tone expression, as in the case of the first image processing apparatus of the present invention. The arrangement of the second image processing apparatus also enables the image data correction unit and the color reduction process unit to be designed independently. This arrangement enhances the flexibility and requires the change of only the image data correction unit in the case of a variation in display characteristic of the image display apparatus.

In the second image processing apparatus, it is preferable that the preset number of divisions are obtained by dividing the range of the tone correction into substantially equal parts. Especially preferable are divisions of powers of 2.

This arrangement ensures uniform color reduction in the respective divisions. The 'equal parts' may not be strictly equal to one another. Divisions of powers of 2 enhance the rate of arithmetic operations and thereby the rate of image processing in the image processing apparatus with a computer.

The present invention is also directed to a third image processing apparatus that carries out predetermined image processing of image data, which are to be displayed on an image display apparatus, and generates supplied data to the image display apparatus, and has a non-linear display characteristic in which the number of expressible tones for each pixel is fewer than that of the image data and the output lightness is provided at varying intervals. The third image processing apparatus includes a color reduction process unit that divides a range of tone values of the image data into plural divisions of varying widths corresponding to the non-linear display characteristic and allocates tone values in each division to each display tone value according to a predetermined rule, so as to implement color reduction.

The third image processing apparatus of the present invention divides the range of tone values into divisions of varying widths corresponding to the non-linear display characteristic of the image display apparatus, and carries out color reduction that allocates the tone values in each division to each display tone value according to a predetermined rule. This ensures an approach to ideal tone expression, as in the case of the first and the second image processing apparatuses discussed above.

In the fist through the third image processing apparatus of the present invention, it is preferable that the color reduction process unit carries out a dispersion-type halftoning process for color reduction.

The 'dispersion-type halftoning process' prevents the pixels having the same display tone value from collectively appearing after the color reduction process. Known techniques, such as dither method and error diffusion method, may be applicable for such halftoning process.

Application of the dispersion-type halftoning process for color reduction assures dispersion of pixels having identical lightness in a predetermined area. This effectively prevents the appearance of the quasi-contour and improves the picture quality of the resulting displayed images.

In the image processing apparatus having any of the above arrangements, the image display apparatus may be a liquid crystal display apparatus applied for a cellular phone and implements frame rate control-type tone display.

The liquid crystal display apparatus that provides the frame rate control-type tone display generally gives, due to its actuation system, output lightness varying stepwise against expressible display tone value and has a non-linear display characteristic providing the output lightness at varying intervals in at least one of a low tone region and a high tone region. This liquid crystal display apparatus has the better rate of power consumption than a liquid crystal display apparatus of pulse width modulation-type actuation, and may thus be mounted on cellular phones of small battery capacities. The principle of the present invention is thus applicable to image processing of image data, which are to be supplied to a liquid crystal display apparatus that is used for cellular phones, provides frame rate control-type tone display, and has a less number of expressible tones.

In accordance with one preferable embodiment of the first and the second image processing apparatus, the image data correction unit carries out the tone correction that reduces a tone distribution in an intermediate tone region while enhancing tone distributions in both a low tone region and a high tone region.

This arrangement enhances the contrast of the displayed images. In the case where an intermediate tone region corresponds to the area of wide intervals of lightness output from the image display apparatus and a high tone region and a low tone region correspond to the area of narrow intervals of lightness, the tone correction is opposite to the tone correction discussed above. In this case, the tone correction is carried out to some extent that does not damage the effects of the previous tone correction. The dispersion-type halftoning process carried out by the color reduction process unit of the image processing apparatus reduces the frequency that pixels having a significant difference in lightness adjoin to each other in the intermediate tone region, thus improving the picture quality of the resulting displayed images.

In accordance with one preferable application of the present invention, the second image processing apparatus further includes storage means that stores therein a mapping of tone values of the input image data to corrected tone values. The image correction unit refers to the storage means to correct the tone values. This application is also preferable in the first image processing apparatus of the present invention.

This arrangement refers to the relationship between the tone values of the input image data and the tone values of the corrected image data, which is stored in advance, thus facilitating correction of image data. The storage means may be a look-up table or arithmetic operations with preset functions.

The second image processing apparatus of the above application may further include: a plurality of the storage means that are provided corresponding to a plurality of settings for a predetermined condition, the predetermined condition affecting the display characteristic of the image display apparatus; and a storage means selection unit that selects one among the plurality of storage means, based on an input setting for the predetermined condition.

For example, the predetermined condition may be temperature around the image display apparatus.

The display characteristic of the image display apparatus may vary according to the temperature of the environment in which the image display apparatus is used. The arrangement of appropriately changing the storage means, which is used for the tone correction of image data, according to the environmental temperature effectively improves the picture quality of the resulting displayed images. The environmental temperature may be input manually or automatically from a temperature sensor.

In another example, the predetermined condition may be brightness around the image display apparatus.

The display characteristic of the image display apparatus may vary according to the brightness of the environment in which the image display apparatus is used. The arrangement of appropriately changing the storage means, which is used for the tone correction of image data, according to the brightness of the working environment effectively improves the picture quality of the resulting displayed images. The brightness may be input manually or automatically from a photo sensor.

In accordance with one preferable application of the present invention, the image display apparatus is a liquid crystal display apparatus with a backlight, and the predetermined condition is brightness of the backlight.

The display characteristic of the liquid crystal display apparatus varies according to the brightness of the backlight. The arrangement of appropriately changing the storage means, which is used for the tone correction of image data, according to the on-off state and the brightness of the backlight effectively improves the picture quality of the resulting displayed images.

In still another example, the predetermined condition may be a setting of a contrast adjuster that adjusts display contrast of the image display apparatus. The contrast adjuster is, for example, an electronic volume.

The display characteristic of the image display apparatus varies according to the setting of the contrast adjuster. The arrangement of appropriately changing the storage means, which is used for the tone correction of image data, according to the setting of the contrast adjuster effectively improves the picture quality of the resulting displayed images.

The present invention is further directed to a fourth image processing apparatus that carries out preset tone correction of image data, which are to be displayed on an image display apparatus. The image display apparatus has a less number of expressible display tones with regard to each pixel than a number of tones included in the image data and gives output lightness varying stepwise against display tone value. The fourth image processing apparatus includes: a first storage unit that stores a plurality of characteristic curves corresponding to a plurality of settings for a predetermined parameter, each characteristic curve representing a relationship between the tone value of the image data and the lightness; a second storage unit that stores therein a preset characteristic curve that represents a desired relationship between the tone value and the lightness; a data generation unit that receives an input of the predetermined parameter, selects a characteristic curve among the plurality of characteristic curves according to the input of the predetermined parameter, and generates data that represents a mapping of tone values of input image data to corrected tone values, based on the selected characteristic curve and the preset characteristic curve, so as to compensate for a difference between the selected characteristic curve and the preset characteristic curve; and an image data correction unit that corrects tone values of the input image data by referring to the generated data.

In this arrangement, data representing the relationship between the tone values of the input image data and the tone values of the corrected image data are generated according to the input of the predetermined parameter and used for tone correction of the image data. This effectively improves the picture quality of the resulting displayed images. The 'predetermined parameter' here includes parameters that affect the display characteristic of the image display apparatus, such as the temperature and the brightness of the environment in which the image display apparatus is used.

The above description regards the image display apparatus having the non-linear display characteristic. Application of the tone correction technique of the present invention is, however, not restricted to the image display apparatus having the non-linear display characteristic.

From this point of view, the present invention is also directed to a fifth image processing apparatus that carries out predetermined image processing of image data, which are to be displayed on an image display apparatus, and thereby generates supplying data to the image display apparatus. The fifth image processing apparatus includes: storage means that stores in advance a relationship between tone values before and after tone correction, which is set based on a display characteristic of the image display apparatus; an image data correction unit that carries out tone correction of the image data, based on the stored relationship; and a color reduction process unit that carries out color reduction to convert tones of the corrected image data into tones expressible by the image display apparatus.

Like the image processing apparatuses discussed above, it is preferable that the color reduction process unit of the fifth image processing apparatus carries out a dispersion-type halftoning process.

The fifth image processing apparatus carries out the tone correction according to the display characteristic of the image display apparatus, which may be a linear variation. The display characteristics to be considered by the fifth image processing apparatus include the general bias of lightness, an increase in lightness with an increase in display tone value, and the number of expressible tones.

The 'relationship' to be stored in the storage means is set analytically or experimentally by taking into account such characteristics. The relationship is not restricted to one, but a plurality of relationships may be provided in advance.

In accordance with one preferable embodiment of the present invention, the fifth image processing apparatus includes: a plurality of the storage means that are provided corresponding to a plurality of settings for a predetermined condition, the predetermined condition affecting the display characteristic of the image display apparatus; and a storage means selection unit that selects one among the plurality of storage means, based on an input setting for the predetermined condition.

This arrangement enables appropriate selection of the relationship according to the setting of the predetermined condition, thus attaining adequate tone correction.

The present invention is also directed to a method of generating data that are used for predetermined tone correction of image data, which are to be displayed on an image display apparatus. The image display apparatus has a less number of expressible display tones with regard to each pixel than a number of tones included in the image data and gives output lightness varying stepwise against display tone value. The data generating method includes the steps of: (a) specifying a characteristic curve that represents a current relationship between the tone value of the image data and the lightness; (b) presetting a characteristic curve that represents a desired relationship between the tone value and the lightness; and (c) generating data that represents a mapping of tone values of input image data to corrected tone values, based on the characteristic curve specified in the step (a) and the characteristic curve preset in the step (b), so as to compensate for a difference between the specified characteristic curve and the preset characteristic curve.

This method generates the data used for tone correction carried out in the fourth image processing apparatus discussed above.

The present invention is actualized by image processing methods, in addition to the image processing apparatuses and the method of generating data used for tone correction discussed above. Other possible applications of the present invention include computer programs that attain these methods, data used for such computer programs, recording media in which such computer programs are recorded, and data signals that include such computer programs and are embodied in carrier waves. The variety of additional factors discussed above may be adopted in such applications.

When the principle of the present invention is actualized by the computer program or the recording medium in which the computer program is recorded, the construction may include the whole program for driving the image processing apparatus or only part that implements the functions of the present invention. Typical examples of the recording medium include flexible disks, CD-ROMs, magneto-optic discs, IC cards, ROM cartridges, punched cards, prints with barcodes or other codes printed thereon, internal storage devices (memories like a RAM and a ROM) and external storage devices of the computer, and a variety of other computer readable media.

These and other objects, features, aspects, and advantages of the present invention will become more apparent from the following detailed description of the preferred embodiments with the accompanying drawings.

BRIEF DESCRIPTION OF THE DRAWINGS

FIG. 3 shows a color table that represents the mapping of 8-bit pallet index colors into 24-bit RGB colors;

FIG. 5 shows a tone value correction table LUT that exhibits the tone curve with regard to R (red) shown in the graph of FIG. 4;

DESCRIPTION OF THE PREFERRED EMBODIMENTS

Some modes of carrying out the present invention are discussed below in the following sequence as preferred embodiments, in which the principle of the present invention is applied to a cellular phone:

A. Structure of Cellular Phone
B. Image Processing
C. Modification of First Embodiment
D. Second Embodiment
E. Third Embodiment
F. Fourth Embodiment
G. Fifth Embodiment
H. Modifications

A. Structure of Cellular Phone

Figure 1:
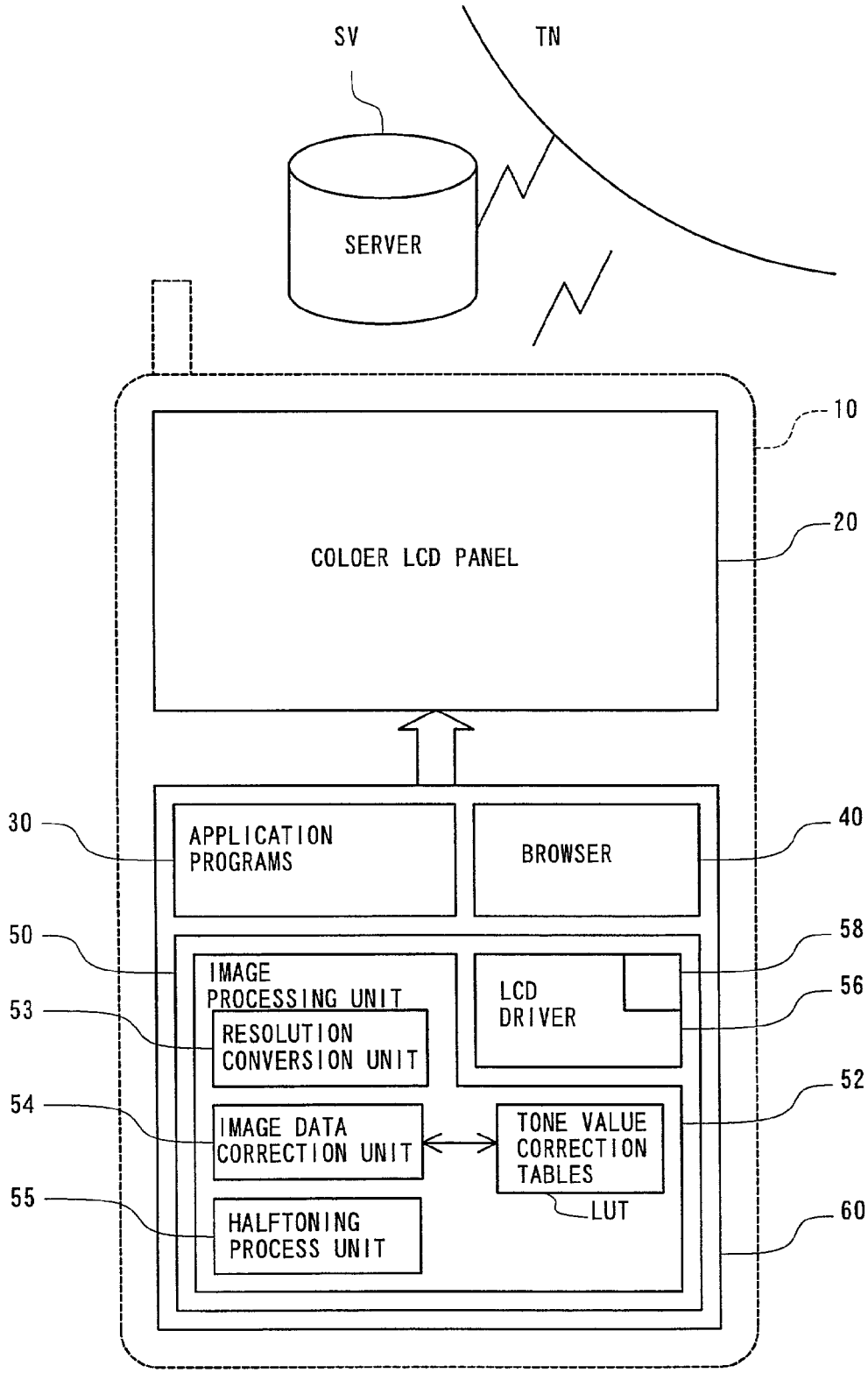
FIG. 1 is a block diagram schematically illustrating the structure of a cellular phone with an image processing apparatus in a first embodiment of the present invention.

FIG. 1 is a block diagram illustrating the structure of a cellular phone 10 with an image processing apparatus in a first embodiment of the present invention. The cellular phone 10 has a color LCD panel 20 as the image display apparatus, and a system unit 60 including a CPU, a ROM, and a RAM. The cellular phone 10 is connected to a server SV via an external network TN to download image data, which is to be displayed on the color LCD panel 20.

The color LCD panel 20 includes a glass substrate, an RGB color filter, a transparent electrode, a polarizer, a backlight, and an LCD driving circuit. The LCD driving circuit is designed to allow display of 256 different colors with 3 bits for R (red), 3 bits for G (green), and 2 bits for B (blue) on the color LCD panel 20 of the embodiment.

Figure 21B:
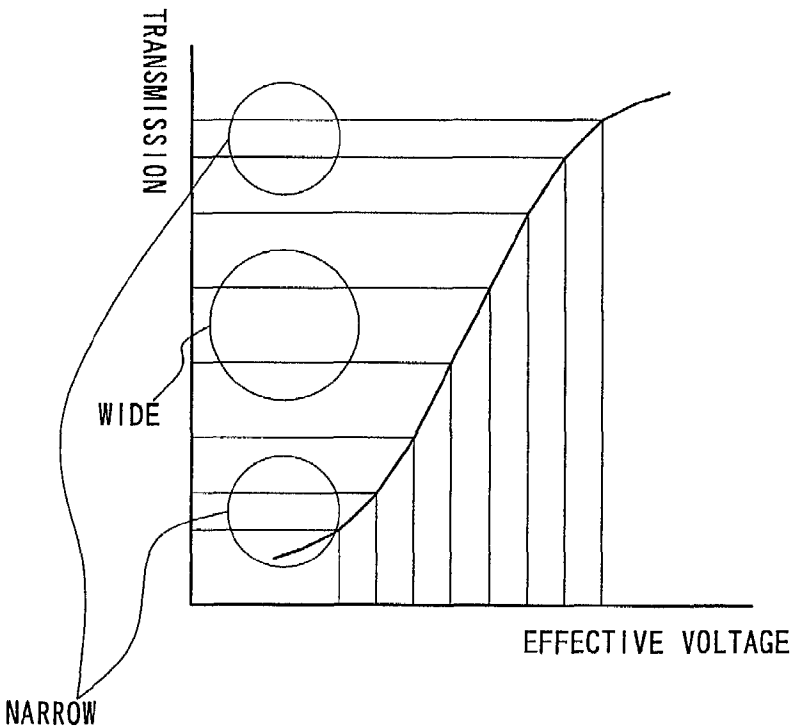
FIGS. 21A and 21B show voltage-transmittance characteristics (V-T characteristics) of the LCD panel.
Figure 21A:
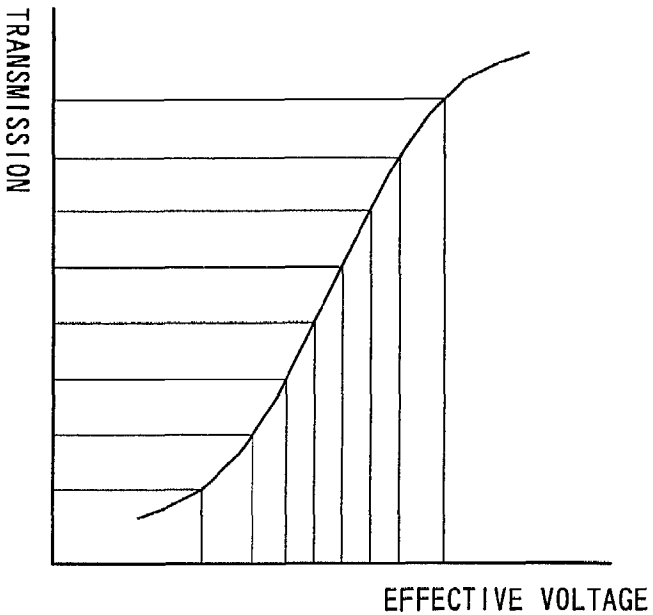

The color LCD panel 20 of the embodiment utilizes STN liquid crystals and is actuated by a passive matrix driving scheme. The color LCD panel 20 adopts a driving circuit that provides a low power consumption, frame rate control-type tone display, and has effective driving voltages set at equal intervals (see FIG. 21B). The color LCD panel 20 accordingly has display characteristics: wider intervals of expressible lightness in an intermediate tone region and narrower intervals of expressible lightness in both a low tone region and a high tone region.

The system unit 60 has application programs 30, a browser 40, and an image processing module 50. The application programs 30 include a PIM (Personal Information Manager) that enables the user to manage information of the individual level (for example, directories and schedules), an e-mail software programs, and a software program to display a standby window, such as 'Receive Ready'. The browser 40 is a software program that gives a display to allow the user to browse data downloaded from the server SV.

The image processing module 50 includes an image processing unit 52 and an LCD driver 56, and generates tone signals R (red), G (green), and B (blue) and timing signals to control actuation of respective liquid crystal cells in the color LCD panel 20. The image processing unit 52 has a resolution conversion unit 53, an image data correction unit 54, tone value correction tables LUT that are referred to by the image data correction unit 54, and a halftoning process unit 55. The LCD driver 56 has an electronic volume 58 to adjust the contrast of display on the color LCD panel 20. The electronic volume 58 has been adjusted to give the maximum contrast on the color LCD panel 20 on shipment.

The resolution conversion unit 53 converts the resolution of color image data processed and handled by the application programs 30 and the browser 40 into a resolution processible and handlable by the LCD driver 56. The image data correction unit 54 refers to the tone value correction tables LUT, which respectively store therein the mapping of the tone values of input image data to the corrected tone values, and corrects the tone values of the image data. The tone value correction tables LUT have been set in advance according to the display characteristics of the color LCD panel 20. The halftoning process unit 55 carries out a process of halftoning the image data corrected by the image data correction unit 54.

B. Image Processing

Figure 2:
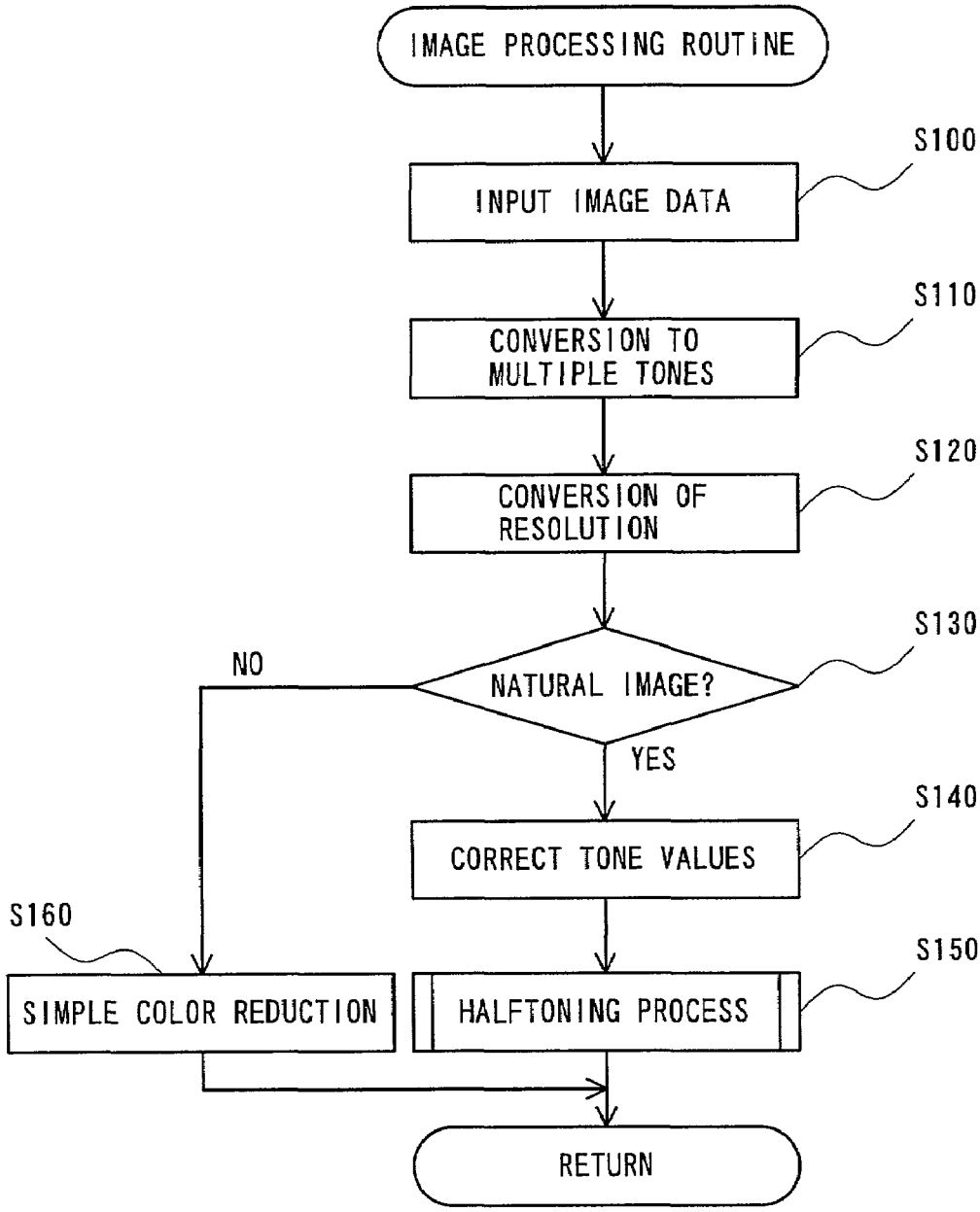
FIG. 2 is a flowchart showing an image processing routine that is carried out in the image processing module shown in FIG. 1.

FIG. 2 is a flowchart showing an image processing routine that is carried out in the image processing module 50, or more specifically, is executed by the CPU in the system unit 60. When entering this routine, the process control first inputs image data at step S100. In this embodiment, the input image data are given in a GIF (graphics interchange format) file, and the color of each pixel is expressed by 8-bit pallet index colors (256 colors). Prior to the input of the GIF file, a color table, which represents the mapping of the pallet index colors to tone values expressed with 8 bits each for R, G, and B (total 24 bits) is input and stored into the RAM.

The process control subsequently converts the respective 8-bit image data into 24-bit RGB colors (8 bits each for R, G, and B) at step S110. FIG. 3 shows a color table that represents the mapping of 8-bit pallet index colors into 24-bit RGB colors. The color table depends upon the input image data as mentioned above. This color table converts the 8-bit pallet index colors into the 24-bit RGB colors.

The process control then converts the resolution to be compatible with display on the color LCD panel 20 at step S120.

At decision point S130, it is determined whether or not the input image represented by the input image data is a natural image. The decision is based on the number of colors used for the image. In the case where the number of colors used for the input image is less than a predetermined value, the program control determines that the input image is not a natural image and carries out simple color reduction at step S160. The program then exits from this routine. In the case where the number of colors used for the input image is not less than the predetermined value, on the other hand, the program control determines that the input image is a natural image and carries out the following series of processing.

When it is determined at step S130 that the input image is a natural image, the process control refers to the tone value correction tables LUT (discussed later in detail) and corrects the tone values of the respective 24-bit image data at step S140. The tone value correction tables LUT are one-dimensional look-up tables provided separately for R, G, and B.

Figure 4:
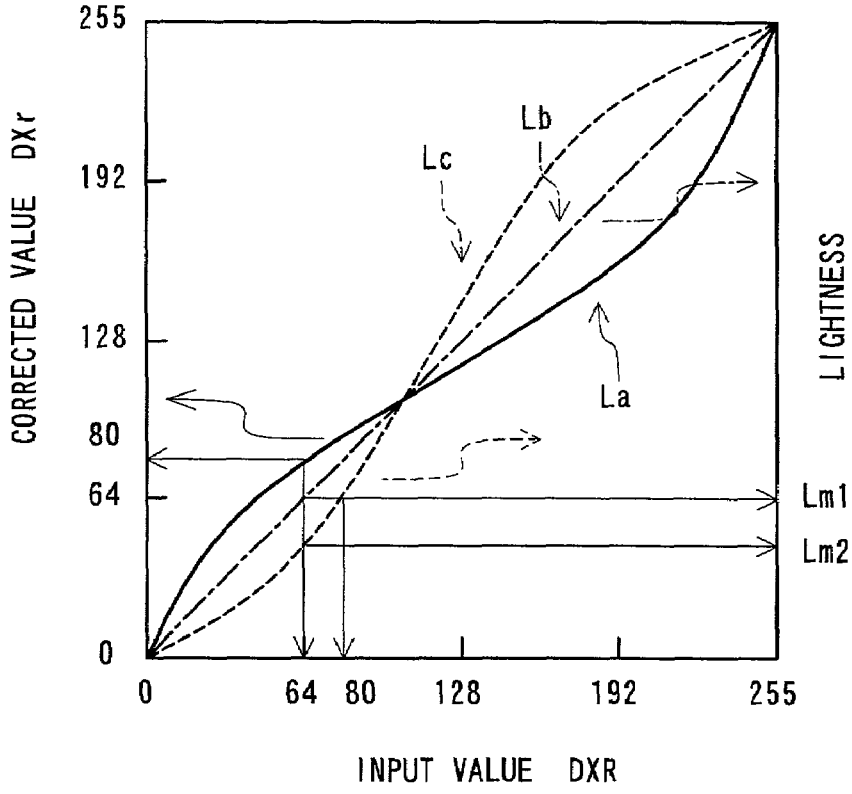
FIG. 4 is a graph showing a tone curve with regard to R (red) that represents the mapping of tone values DXR of input image data to tone values DXr of corrected image data.

The correction of the tone values at step S140 is performed by applying tone curves for the input image data as discussed below. FIG. 4 is a graph showing a tone curve with regard to R (red) that represents the mapping of tone values DXR of input image data to tone values DXr of corrected image data. A solid line curve La represents the tone curve. For convenience of explanation, it is assumed that an image display apparatus has non-linear display characteristics to allow output of the lightness by 256 tones against 256 input tone values. The graph also shows the mapping of the input tone values DXR to the lightness output by the image display apparatus. A curve of one-dot chain line Lb represents ideal display characteristics. The 'ideal display characteristics' exhibit a linear relationship between the display tone value (here the input value) and the lightness. A curve of broken line Lc represents non-linear display characteristics of the image display apparatus.

The tone curve functions to compensate for the non-linear display characteristics of the image display apparatus. For example, the ideal display characteristics output a lightness Lm1 against an input value DXR =64. The image display apparatus, however, outputs another lightness Lm2, because of its non-linear display characteristics represented by the broken line curve Lc. The image display apparatus outputs the lightness Lm1 against an input value DXR=80 as illustrated in the graph. The tone curve accordingly corrects the input value DXR=64 into the corrected value DXr =80. Such correction of the tone values is applicable to data, which are supplied to the color LCD panel 20 having a less number of expressible display tones than the number of tones of the input image data.

The tone curve is set arbitrarily according to the display characteristics of the color LCD panel 20. The tone curve may be specified by taking into account the gamma characteristics of the color LCD panel 20 and the visual sensitivity of human eyes. Similar tone curves are provided with regard to G (green) and B (blue) to represent the mapping of the tone values of input image data to the tone values of corrected image data.

FIG. 5 shows a tone value correction table LUT that exhibits the tone curve with regard to R (red) shown in the graph of FIG. 4. The tone value correction table LUT is stored in the ROM included in the image processing module 50 (see FIG. 1). Similar tone value correction tables LUT with regard to G (green) and B (blue) are also stored in the ROM. The tone values may readily be corrected by referring to these tables LUT.

On completion of the correction of the tone values, the process control carries out a halftoning process at step S150. The halftoning process implements color reduction from 8 bits each for R, G, and B (256 tones) to 3 bits (8 tones) for R and G and 2 bits (4 tones) for B, in order to allow actuation and control by the driving circuit of the color LCD panel 20. The halftoning process is performed for each component of R, G, and B. Known techniques like dither method and error diffusion method are applicable for the halftoning process. The procedure of this embodiments adopts the dither method.

Figure 6:
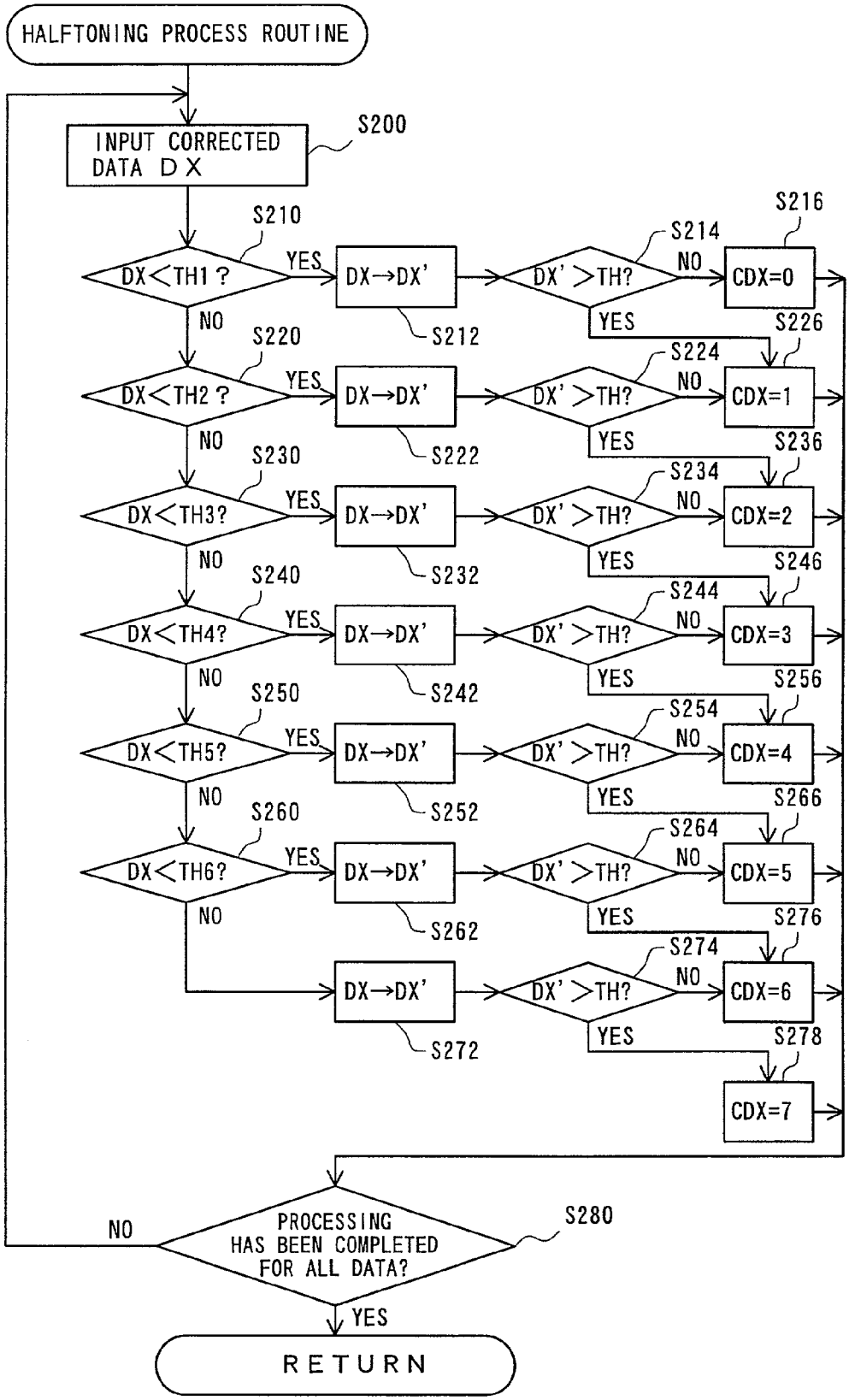
FIG. 6 is a flowchart showing a halftoning process routine executed in this embodiment.

FIG. 6 is a flowchart showing a halftoning process routine executed in this embodiment. The routine of FIG. 6 regards the processing for R (red) and G (green), which implements color reduction from the 256 tones of the input tone data to 8 tones. The procedure of this embodiment applies the dither method for the halftoning process and provides one 4×4 dither matrix, which has an arrangement of threshold values TH of 0 to 15. Separately from the threshold values TH in the dither matrix, threshold values TH1 to TH6 (0<TH1<TH2< . . . <TH6<255) are provided to map the 256 tones of image data to 8 tones. The threshold values TH1 to TH6 may have arbitrary settings. In the procedure of the embodiment, the threshold values TH1 to TH6 are set at substantially equal intervals (TH1=36, TH2=73, TH3=109, TH4=146, TH5=182, TH6=219), so as to ensure practically even data processing in the respective divisions parted by the threshold values TH1 to TH6.

Figure 7:
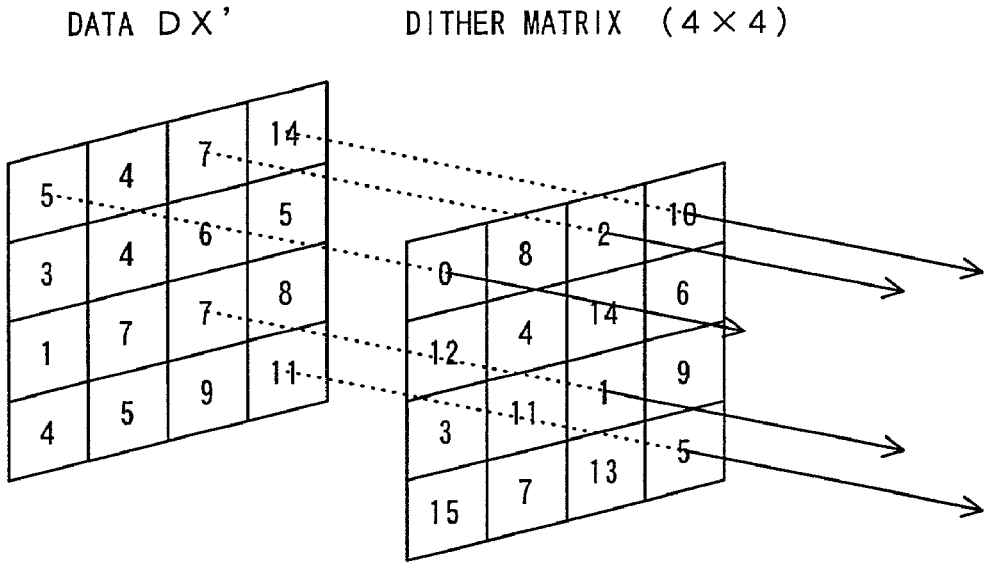
FIG. 7 shows a dither matrix as an example.

FIG. 7 shows a dither matrix as an example. The procedure compares data DX' (discussed later) with the threshold values TH in the dither matrix and specifies the tone values after the color reduction, based on the results of the comparison. Although the 4×4 dither matrix is used in the procedures of this embodiment, the dither matrix may have any size.

When the program enters the halftoning process routine, at step S200, the process control first inputs the corrected data DX obtained at step S140 in the flowchart of FIG. 2.

The corrected data DX is compared with a threshold value TH1 at step S210. In the case where the corrected data DX is less than the threshold value TH1, the value DX in the range of 0 to TH1 is normalized to a value DX' in the range of the threshold values TH in the dither matrix, that is, in the range of 0 to 15, at step S212. For example, when the corrected data DX=24 and the threshold value TH1=36, the normalized value DX' is calculated as DX'=15DX/TH1=10. The normalized value DX' obtained at step S212 is then compared with the threshold value TH in the dither matrix at step S214. When the normalized value DX' is not greater than the threshold value TH, the value 0 is set to a display tone value CDX (CDX=0) at step S216. When the normalized value DX' is greater than the threshold value TH, on the other hand, the display tone value CDX=1 at step S226.

In the case where the corrected data DX is not less than the threshold value TH1 at step S210, on the contrary, the corrected data DX is subsequently compared with a next threshold value TH2 at step S220. In the case where the corrected data DX is less than the threshold value TH2, the value DX in the range of TH1 to TH2 is interpolated and corrected to the value DX' in the range of the threshold values TH in the dither matrix, that is, in the range of 0 to 15, at step S222. In this case, the corrected value DX' is calculated as DX'=15 (DX−TH1)/(TH2−TH1). The corrected value DX' obtained at step S222 is then compared with the threshold value TH in the dither matrix at step S224. When the corrected value DX' is not greater than the threshold value TH, the display tone value CDX=1 at step S226. When the corrected value DX' is greater than the threshold value TH, on the other hand, the display tone value CDX=2 at step S236. The similar series of processing is carried out to specify the display tone value CDX.

When the series of processing of step S200 to step S278 is completed for all the pixels, the halftoning process is terminated at step S280. The above procedures are carried out in an iterative manner until all the pixels are processed.

After completion of the halftoning process, the program exits from the image processing routine shown in the flowchart of FIG. 2. A resulting image is then generated according to the display tone values CDX and displayed on the color LCD panel.

A similar halftoning process is executed for B (blue), which implements color reduction from 256 tones of image data to 4 tones. Although the dither method is applied for the halftoning process in the procedures of the embodiment as discussed above, another technique, such as error diffusion method, may alternatively be adopted.

As discussed above, the procedure of the embodiment implements the tone correction to compensate for the non-linear characteristics of the color LCD panel 20, thus enabling approach to the ideal image display.

Figure 8B:
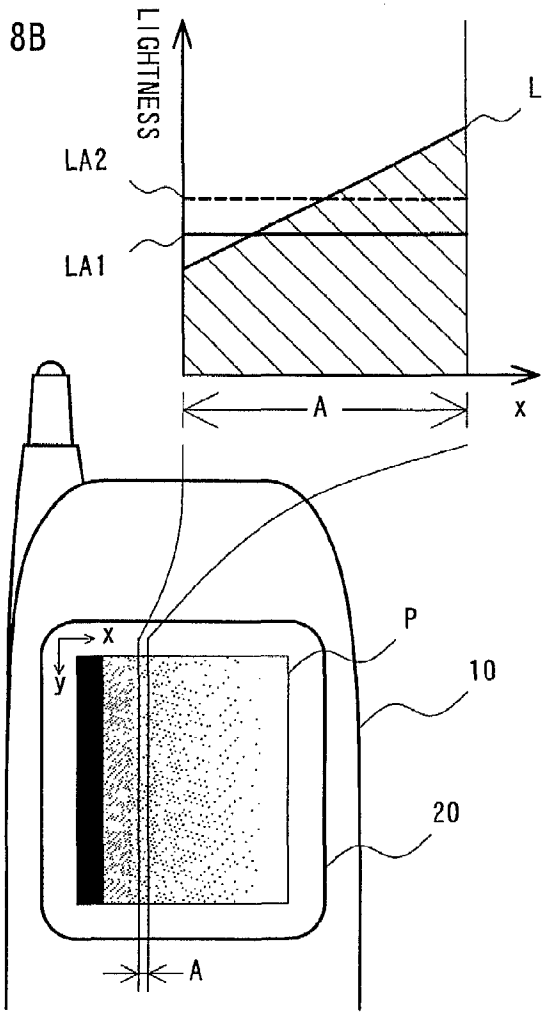
FIGS. 8A and 8B show the effects of tone correction carried out in the first embodiment.
Figure 8A:
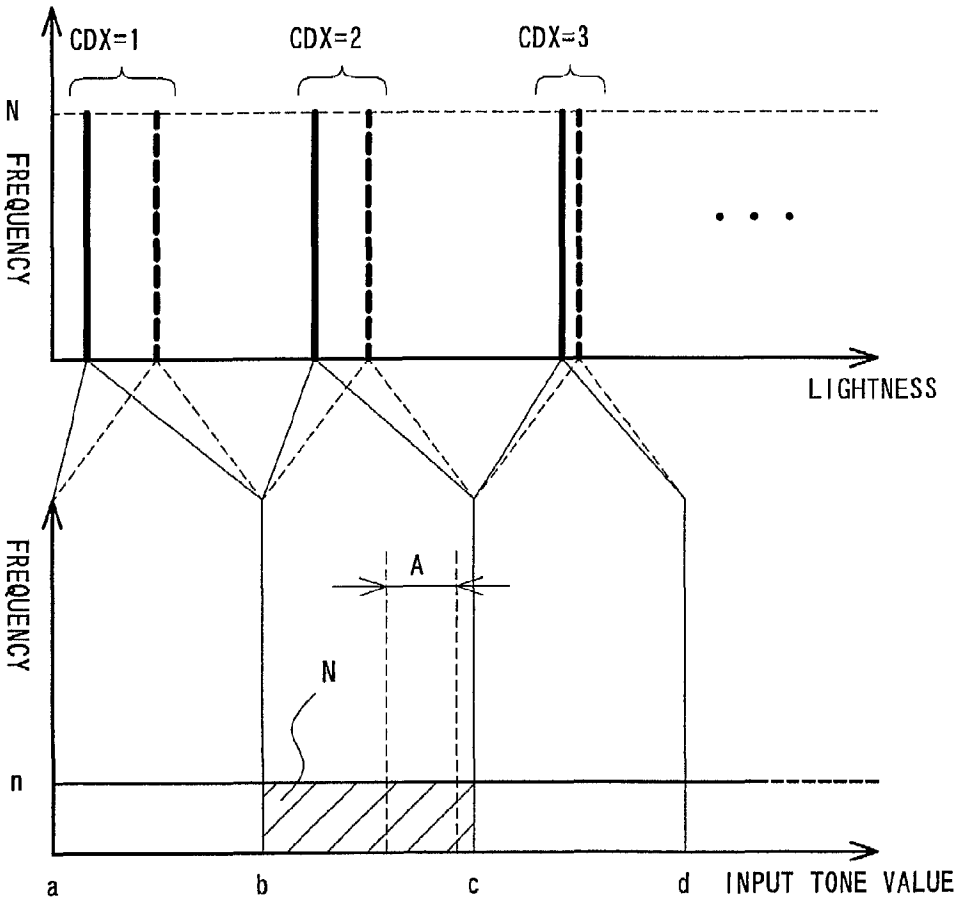
Figure 9:
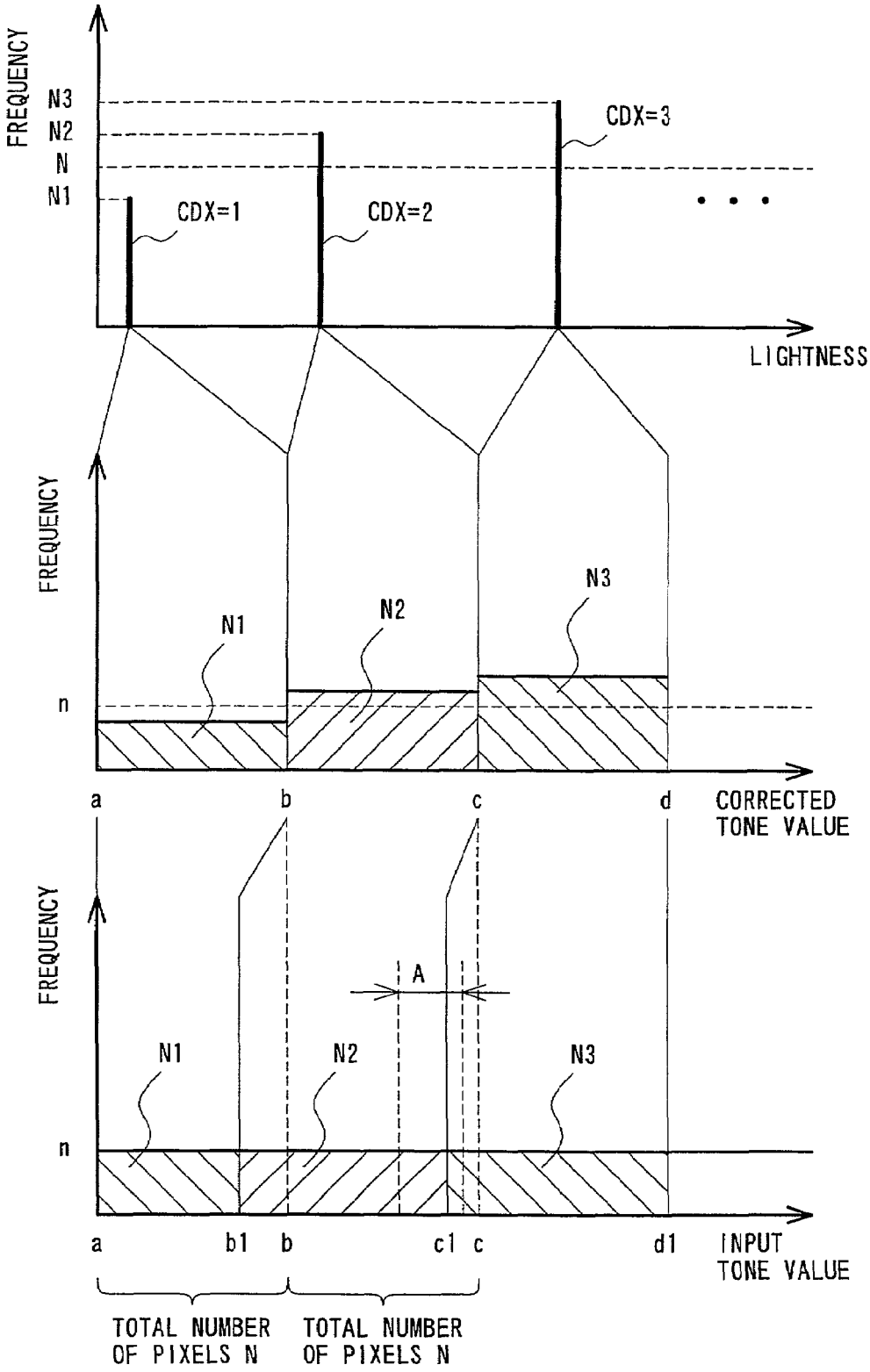
FIG. 9 shows the effects of tone correction carried out in the first embodiment.

FIGS. 8 and 9 show the effects of tone correction carried out in this embodiment. To facilitate understanding, it is here assumed that simple color reduction is carried out after the tone correction and that the interval of lightness displayed against the display tone value in the low tone region and the high tone region is narrower than that in the intermediate tone region. The lower graph of FIG. 8A is a histogram showing the relationship between the input tone value and its frequency (the number of pixels). The upper graph of FIG. 8A is a histogram showing the relationship among the display tone value after the tone correction and the simple color reduction, its frequency, and the lightness.

Figure 20:
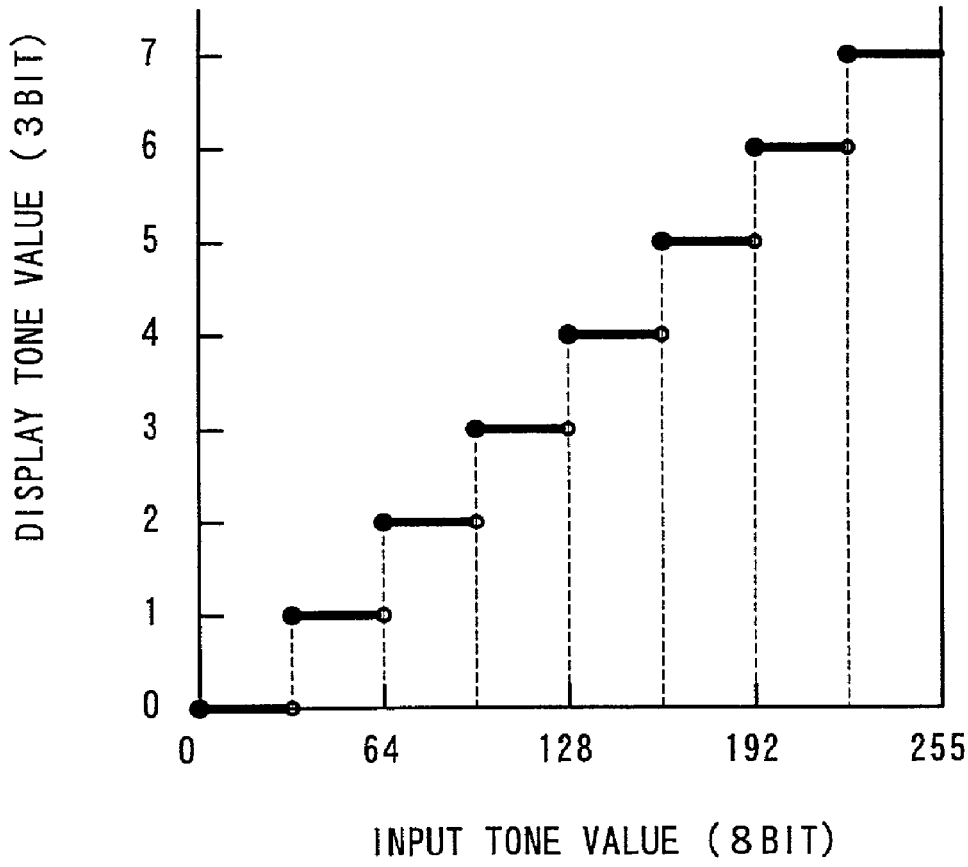
FIG. 20 shows a mapping of 256 tones of image data to 8 tones.

As shown in the lower graph of FIG. 8A, every n pixels in the input data have an identical tone value of the 256 tones. The input data, for example, corresponds to a gradation pattern where the tone value varies from 0 to 255. FIG. 8B shows an example of such gradation pattern. This pattern is represented by rectangular patches on the color LCD panel 20 of the cellular phone 10. The lightness is fixed in the direction y in the drawing, while varying (increasing) in the direction x. When the input data undergo the simple color reduction shown in FIG. 20, pixels in equal divisions a-b, b-c, c-d, . . . of the input tone value are respectively allocated to the display tone values CDX=1, 2, 3, . . . as shown in FIG. 8A. It is assumed that each division includes N pixels. The frequency of each display tone value after the color reduction is then equal to N. In the case of ideal 8-tone display, the respective display tone values have lightness at equal intervals as shown by the thick broken lines in the upper graph of FIG. 8A. In the display having non-linear characteristics like this embodiment, the respective display tone values have lightness at different intervals as shown by the thick solid lines. The fixed frequency N is allocated to each display tone value, regardless of the different intervals of lightness expressed at the respective display tone values. Such allocation causes the lightness expressed as a whole to be deviated from the ideal state.

The deviation of the lightness is described with the low tone division b-c as an example. The division b-c corresponds to a region A of a fixed width in the gradation pattern shown in FIG. 8B. The upper half of FIG. 8B is a graph showing a variation in lightness in the region A. The lightness to be expressed in the region A varies with a linear variation in tone value as shown by a straight line L. The lightness to be expressed by the whole region A corresponds to a hatched area in the graph.

The graph of FIG. 8B also shows the lightness in the case of 8-tone display. As illustrated in FIG. 8A, the pixels in the division b-c are allocated to a fixed display tone value CDX=2. Namely the lightness is fixed in the region A in the case of 8-tone display. The lightness in the case of ideal tone display is shown by a doted straight line LA2, whereas the lightness in the case of tone display having non-linear characteristics is shown by a solid straight line LA1.

In the ideal tone display (broken lines), the lightness corresponding to the display tone value CDX=2 is set equal to an intermediate value of the division b-c. In this state, the lightness expressed by the whole region A, that is, the area defined by the x axis and the straight line LA2, is equal to the hatched area. This proves that the ideal tone display ensures the adequate expression of lightness in the whole region A.

In the tone display having non-linear characteristics (solid lines), the lightness corresponding to the display tone value CDX=2 is set to be less than the intermediate value of the division b-c. The area defined by the x axis and the straight line LA1 is accordingly smaller than the hatched area. FIGS. 8A and 8B illustrate the deviation of lightness in the low tone region. Because of the similar principle, the deviation of lightness to be higher than the appropriate value is found in the high tone region.

The following description regards the display after the tone correction of the embodiment with the tone curve. In this case, the values in divisions a-b1, b1-c1, c1-d1, . . . of the input tone value are subjected to tone correction and converted to values in divisions a-b, b-c, c-d, . . . of the corrected tone value as shown by the middle graph and the lower graph of FIG. 9. Pixels in the equal divisions a-b, b-c, c-d, . . . of the corrected tone value are allocated to the display tone values CDX=1, 2, 3, . . . as shown by the middle graph and the upper graph of FIG. 9. The illustration of the middle graph of FIG. 9 is on the assumption that the frequency of the corrected tone value is fixed in each division.

Attention is paid to the divisions a-b1, b1-c1, and c1-d1 of the input tone value. The tone correction with the tone curve shown in FIG. 4 heightens the tone values in the low tone region. For example, the input tone value b1 is converted to the corrected tone value b, which is greater than b1. In a similar manner, the values in the division a-b1 of the input tone value are corrected to the values in the division a-b of the corrected tone value. Since the division a-b1 of the input tone value is narrower than the division a-b, a total number of pixels N1 in the division a-b of the corrected tone value is less than a total number of pixels N in the division a-b of the input tone value. The tone correction with the tone curve shown in FIG. 4 enhances the distribution of the intermediate tones. The values in the division b1-c1 of the input tone value are thus corrected to the values in the narrower division b-c of the corrected tone value. A total number of pixels N2 in the division b-c of the corrected tone value is accordingly greater than the total number of pixels N in the division b-c of the input tone value. The values in the division c1-d1 of the input tone value, which is wider than the division b1-c1, are corrected to the values in the division c-d of the corrected tone value. A total number of pixels N3 in the division c-d of the corrected tone value is thus greater than N2. The pixels in the respective divisions are allocated to the display tone values CDX=1, 2, 3. Pixels in the region A of the input tone value shown in FIG. 8A are allocated to the display tone values CDX=2 and CDX=3 and are expressed with these two display tone values. The lightness expressed by the display tone value CDX=3 is higher than the lightness expressed by the display tone value CDX=2. The lightness expressed by the whole region A displayed on the color LCD panel 20 is thus higher than the lightness in the case without the tone correction. This procedure thus provides an approach to ideal image display apparatus.

The above discussion regards the case without the halftoning process. Similar effects of the tone correction are expected in the case with the halftoning process.

The procedure of the above embodiment applies the halftoning process according to the dither method for the color reduction. This disperses the pixels having an identical display tone value CDX, thus effectively preventing the appearance of the quasi-contour and improving the picture quality of the resulting displayed images.

In the above embodiment, arbitrary settings may be given to the tone curve shown in FIG. 4 and the tone value correction table LUT shown in FIG. 5 according to the display characteristics of the color LCD panel 20. This arrangement ensures the software support on the replacement of the color LCD panel 20 and the adjustment of the picture quality.

C. Modification of First Embodiment

Figure 10:
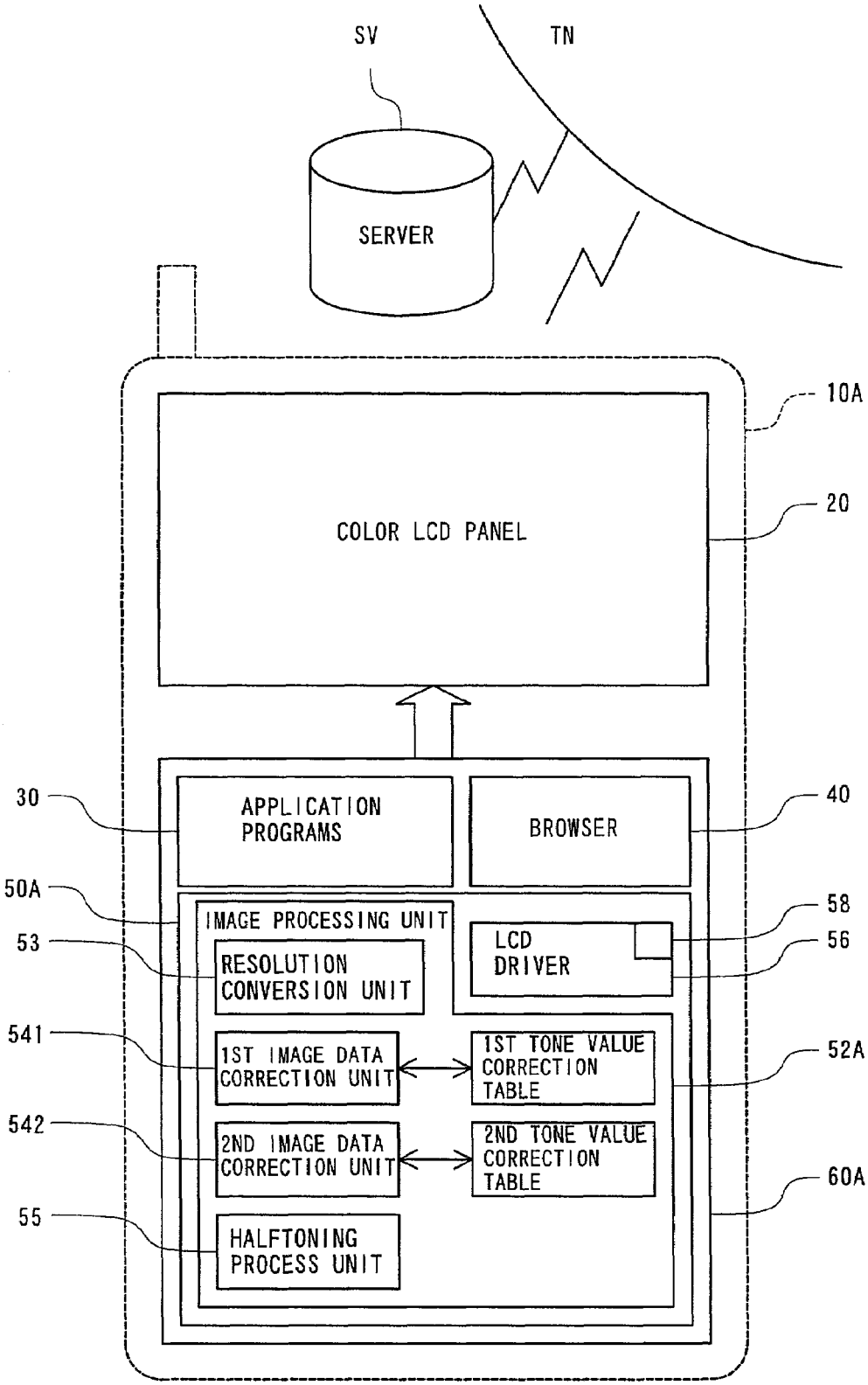
FIG. 10 is a block diagram schematically illustrating the structure of a cellular phone with another image processing apparatus in one modified example of the first embodiment.

FIG. 10 is a block diagram schematically illustrating the structure of a cellular phone 10A with an image processing apparatus in one modified example of the first embodiment. The constituents of this modified example other than those discussed below are identical with those of the first embodiment. The cellular phone 10A has the color LCD panel 20 as the image display apparatus and a system unit 60A. The system unit 60A includes the application programs 30, the browser 40, and an image processing module 50A. The image processing module 50A has an image processing unit 52A and the LCD driver 56. The image processing unit 52A includes the resolution conversion unit 53, a first image data correction unit 541, a second image data correction unit 542, and the halftoning process unit 55. The image processing unit 52A also includes a first tone value correction table and a second tone value correction table, which are respectively referred to by the first image data correction unit 541 and the second image data correction unit 542. The first image data correction unit 541 and the first tone value correction table are identical with the image data correction unit 54 and the tone value correction table LUT of the first embodiment.

The second image data correction unit 542 carries out second tone correction that converts the first corrected value output from the first image data correction unit 541 into a second corrected value. The halftoning process unit 55 then carries out the halftoning process of the second corrected value. The second tone correction by the second image data correction unit 542 is practiced between the processes of steps S140 and S150 in the flowchart of FIG. 2.

Figure 11:
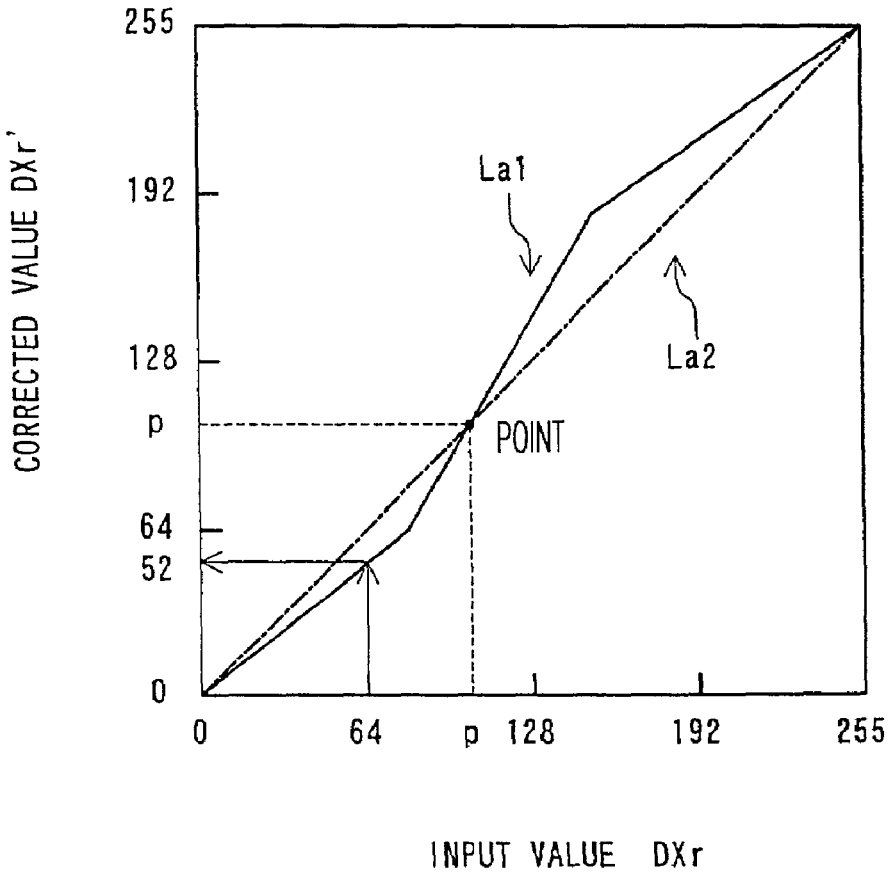
FIG. 11 shows a tone curve with regard to R (red) that represents the mapping of input first corrected values DXr to second corrected values DXr' and is recorded in the second tone value correction table.

FIG. 11 shows a tone curve with regard to R (red) that represents the mapping of input first corrected values DXr to second corrected values DXr' and is recorded in the second tone value correction table. A solid line curve La1 represents the tone curve. For example, the second tone correction converts the first corrected value DXr=64 with regard to a certain pixel into the second corrected value DXr'=52. No tone correction is performed when the setting of the tone curve follows a curve of one-dot chain line La2. In a specific area where the first corrected value DXr is smaller than p, the first corrected value DXr is converted to the second corrected value DXr' that is smaller than DXr. In another area where the first corrected value DXr is greater than p, on the contrary, the first corrected value DXr is converted to the second corrected value DXr' that is greater than DXr.

The second tone correction enhances the contrast in the displayed image. The halftoning process reduces the probability that pixels having a large difference in lightness adjoin to each other in the intermediate tones, thus improving the picture quality of the resulting displayed image. The processing may carry out the first tone correction and the second tone correction in the reverse order. Another applicable procedure may carry out the tone correction only once with a composite tone curve, which is obtained by combining the tone curve for the first tone correction with the tone curve for the second tone correction.

D. Second Embodiment

Figure 12:
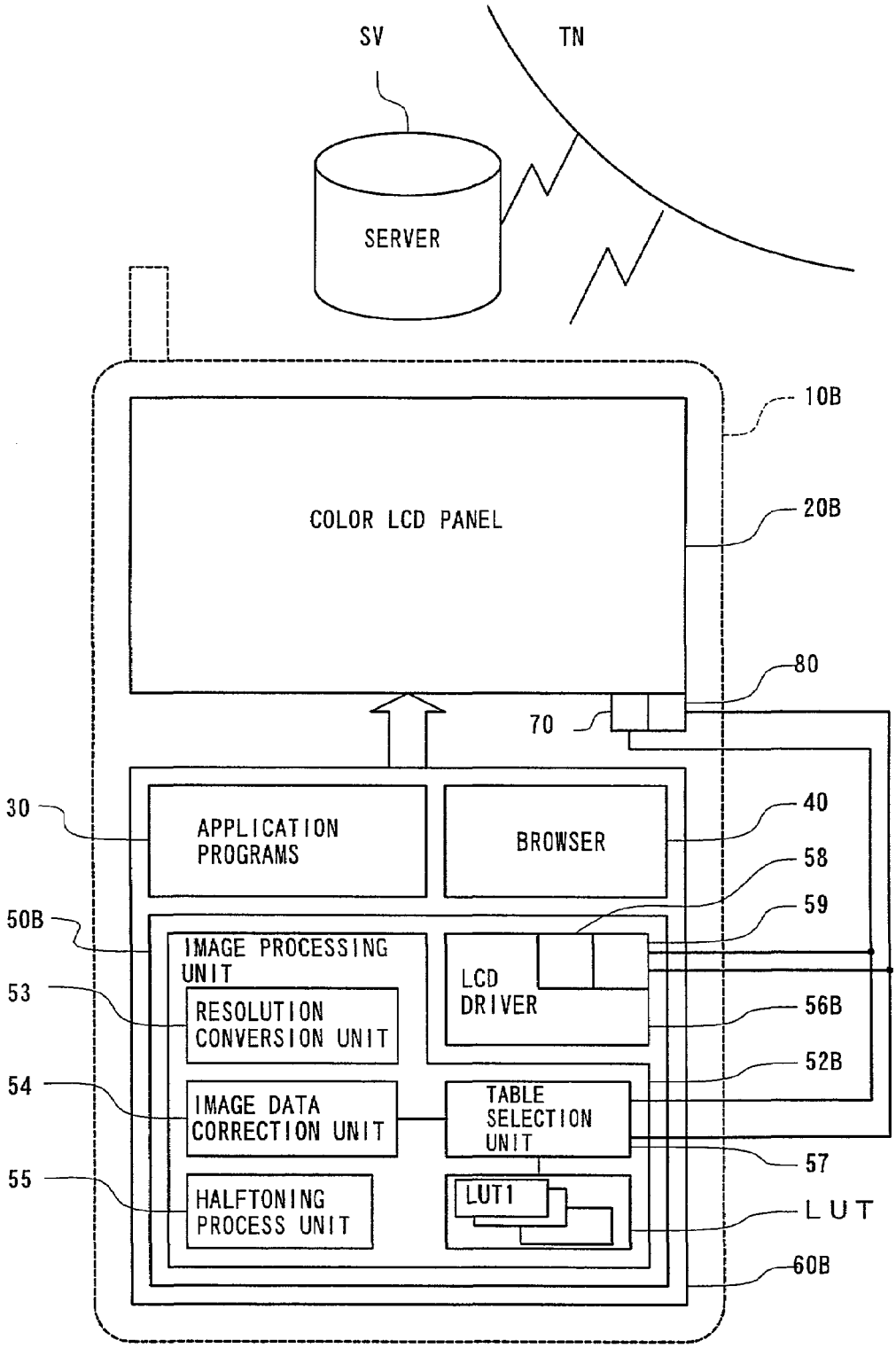
FIG. 12 is a block diagram schematically illustrating the structure of another cellular phone with an image processing apparatus in a second embodiment of the present invention.

FIG. 12 is a block diagram schematically illustrating the structure of a cellular phone 10B with an image processing apparatus in a second embodiment of the present invention. The constituents of the second embodiment other than those discussed below are identical with those of the first embodiment. The cellular phone 10B has a color LCD panel 20 as the image display unit and a system unit 60B. The color LCD panel 20 of the cellular phone 10B is provided with a temperature sensor 70 and an optical sensor 80. The temperature sensor 70 measures the temperature of the environment in which the color LCD panel 20 is used. The optical sensor 80 measures the brightness of the environment in which the color LCD panel 20 is used.

The system unit 60B includes the application programs 30, the browser 40, and an image processing module 50B. The image processing module 50B has an image processing unit 52B and an LCD driver 56B. The image processing unit 52B includes the resolution conversion unit 53, the image data correction unit 54, a plurality of tone value correction tables LUTs referred to by the image data correction unit 54, a table selection unit 57, and the halftoning process unit 55.

Figure 13:
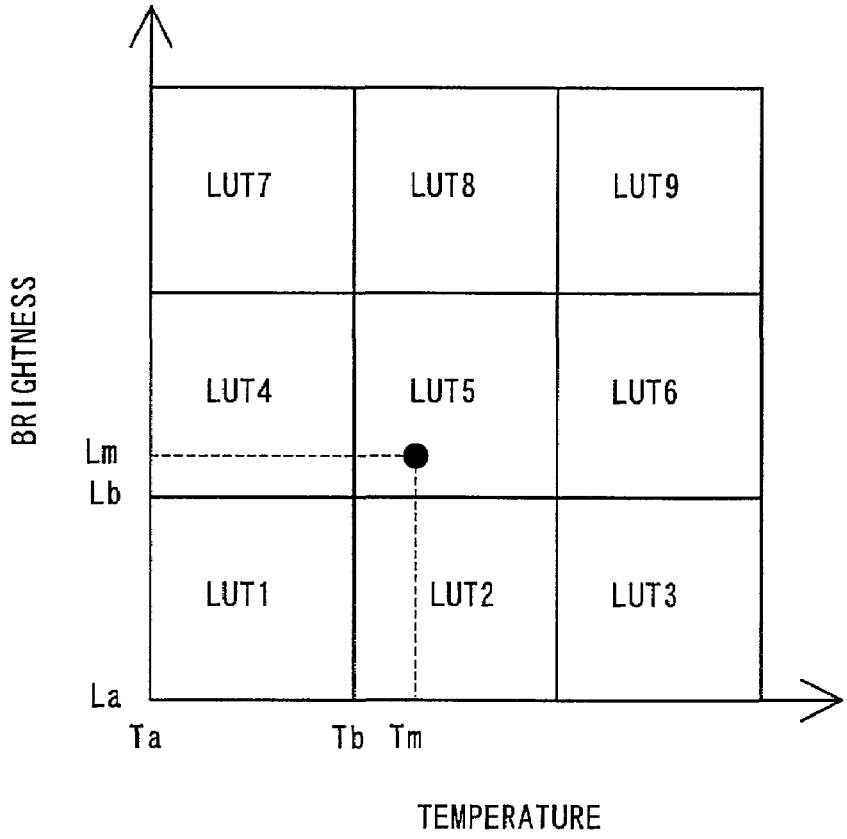
FIG. 13 is a map showing the relationship between the temperature and the brightness of the environment, in which the color LCD panel is used, and the lookup table to be used for tone correction.

The plurality of tone value correction tables LUTs are provided as lookup tables corresponding to a plurality of working environments (combinations of the temperature and the brightness) of the color LCD panel 20. FIG. 13 is a map showing the relationship between the temperature and the brightness of the environment, in which the color LCD panel is used, and the lookup table to be used for tone correction. In this embodiment, 9 lookup tables LUT1 through LUT9 are provided in advance corresponding to different combinations of the temperature and the brightness. For example, the lookup table LUT1 is mapped to a temperature range of Ta to Tb and a brightness range of La to Lb. The table selection unit 57 refers to this map and selects an appropriate lookup table according to the results of measurement by the temperature sensor 70 and the optical sensor 80. For example, the lookup table LUT5 is selected at an observed temperature Tm and an observed brightness Lm.

The LCD driver 56B has the electronic volume 58 and an electronic volume automatic setting unit 59. Like the map of FIG. 13 discussed above, a map is provided to define the relationship between the temperature and the brightness of the environment, in which the color LCD panel 20 is used, and the setting of the electronic volume 58. The electronic volume automatic setting unit 59 refers to this map and specifies the setting of the electronic volume 58 according to the results of measurement by the temperature sensor 70 and the optical sensor 80, so as to maximize the contrast of the color LCD panel 20.

Figure 14B:
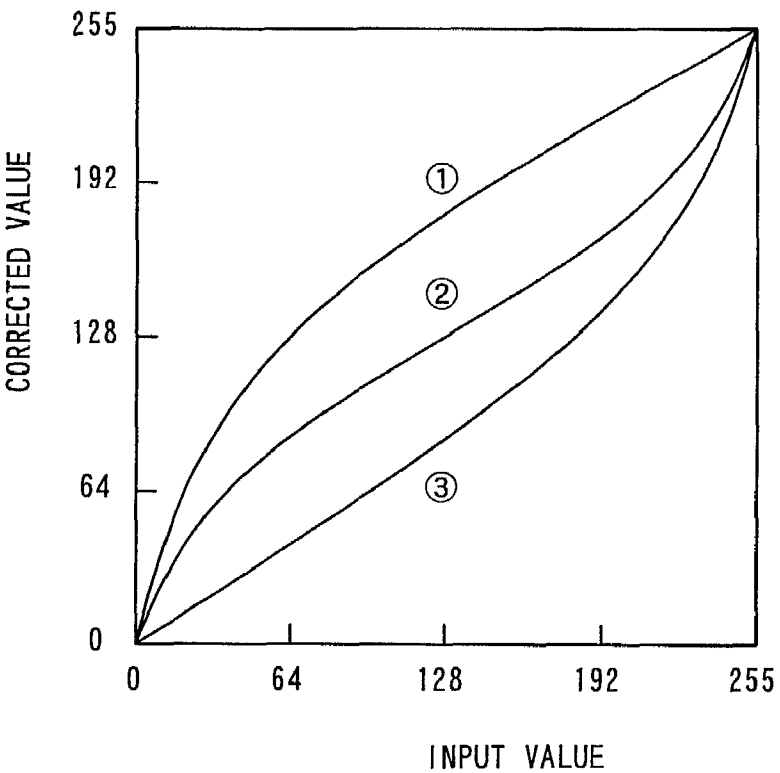
FIGS. 14A and 14B show an example of the relationship between the setting of the electronic volume and the tone curve.
Figure 14A:
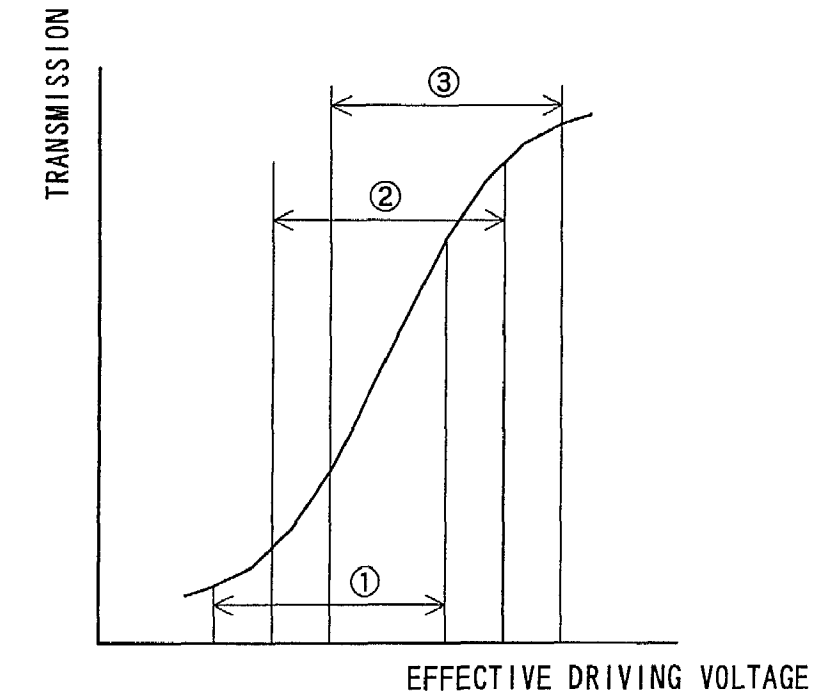
Figure 22:
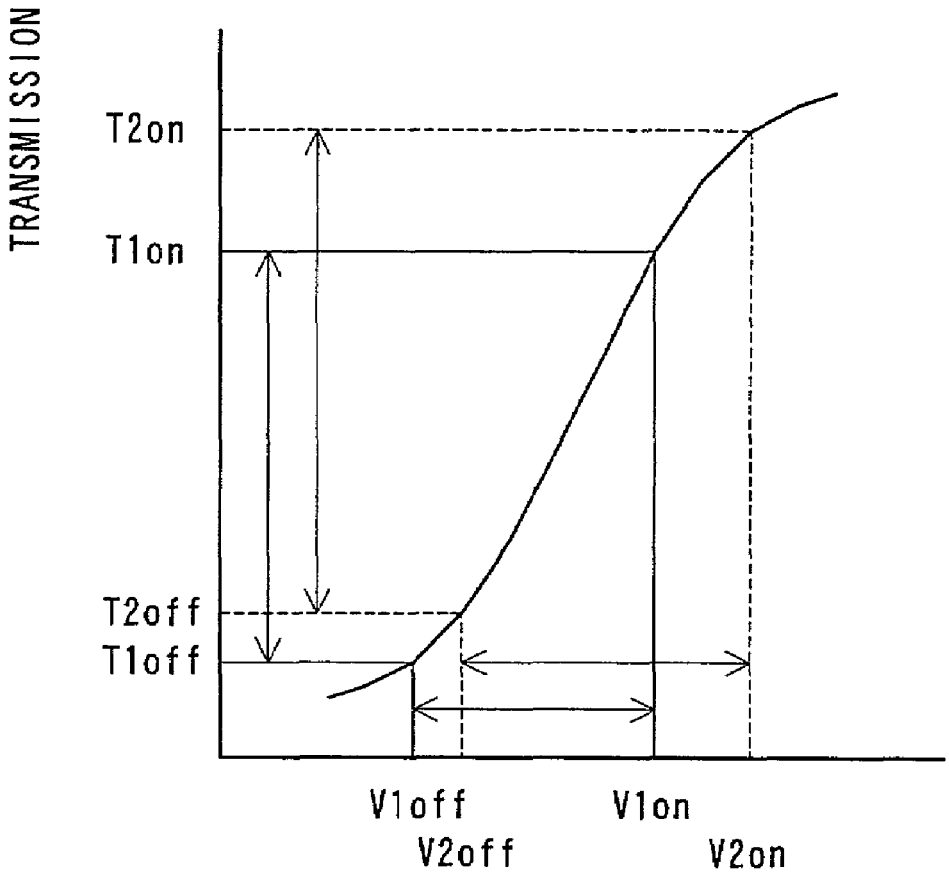
FIG. 22 is a graph showing adjustment of the display contrast of the LCD panel with the electronic volume.

The variation in setting of the electronic volume 58 changes the display characteristics of the color LCD panel 20. The lookup tables LUT1 through LUT9 are thus prepared by taking into account the settings of the electronic volume 58. FIGS. 14A and 14B show an example of the relationship between the setting of the electronic volume 58 and the tone curve. Here it is assumed that the temperature and the brightness of the working environment of the color LCD panel 20 are fixed. As shown in FIG. 14A, a change of the setting of the electronic volume 58 varies the range of the effective driving voltage of the color LCD panel 20 in the sequence of (1), (2), and (3) (see FIG. 22). The tone curve to be used for tone correction is then changed according to the profile of the transimittance of the color LCD panel 20 in the sequence of (1), (2), and (3) shown in FIG. 14B. Like the tone curve discussed in the first embodiment, these tone curves (1), (2), and (3) have the effects of compensating for the non-linear display characteristics of the color LCD panel 20.

As discussed above, the color LCD panel 20 changes its display characteristics according to the environmental conditions including the temperature and the brightness as well as the setting of the electronic volume. The arrangement of the second embodiment gives the appropriate contrast and ensures adequate image processing according to the environmental conditions, in which the color LCD panel 20 is used. This improves the picture quality of the resulting displayed image on the color LCD panel 20.

E. Third Embodiment

Figure 15:
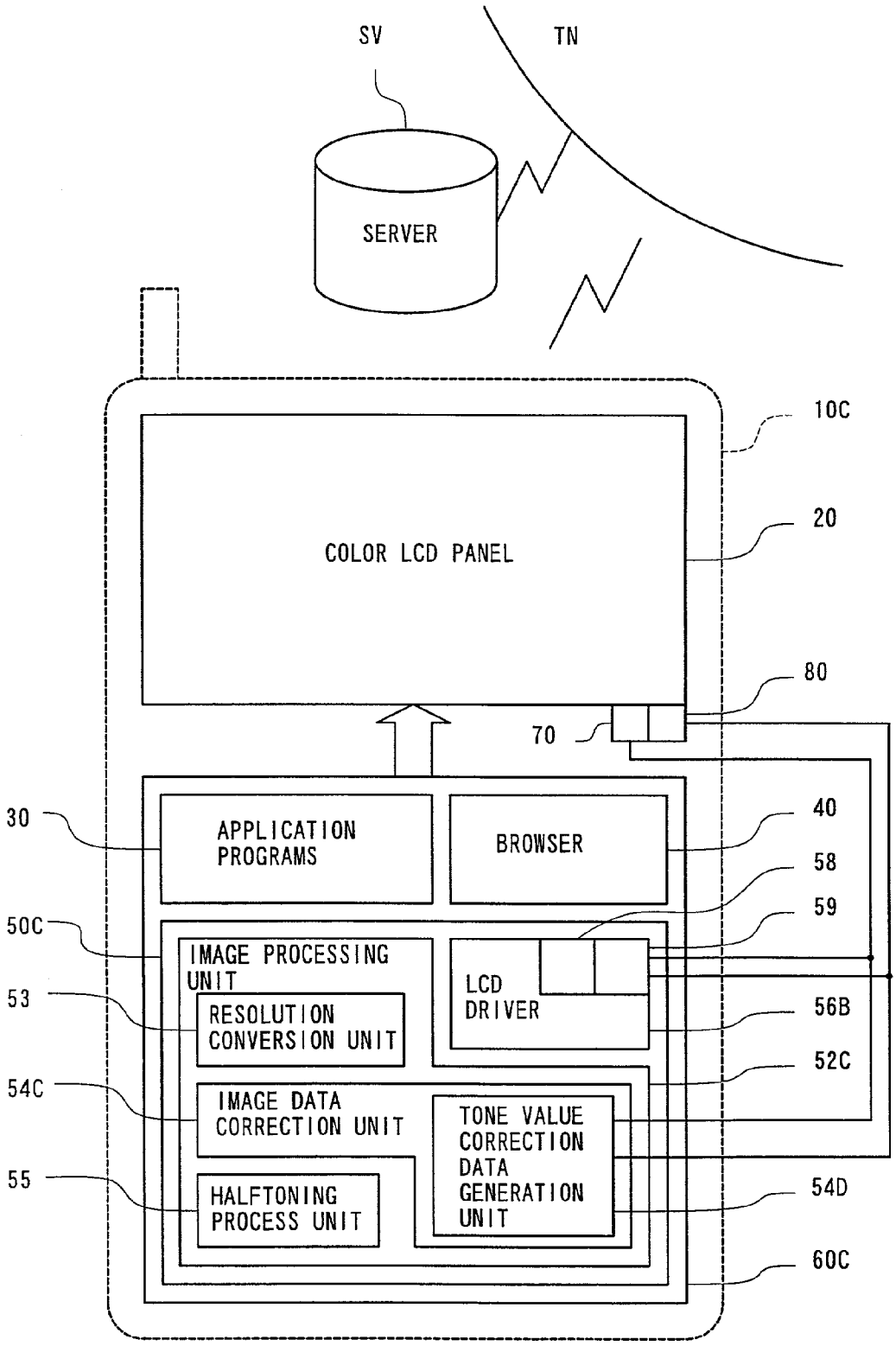
FIG. 15 is a block diagram schematically illustrating the structure of still another cellular phone with an image processing apparatus in a third embodiment of the present invention.

FIG. 15 is a block diagram schematically illustrating the structure of a cellular phone 10C with an image processing apparatus in a third embodiment of the present invention. The constituents of the third embodiment other than those discussed below are identical with those of the second embodiment. The cellular phone 10C has the color LCD panel 20 as the image display apparatus and a system unit 60C. The color LCD panel 20 is provided with the temperature sensor 70 and the optical sensor 80. The observed temperature and brightness with these sensors 70 and 80 are transmitted to the electronic volume automatic setting unit 59 and a tone value correction data generation unit 54D, which will be discussed below.

The system unit 60C includes the applications program 30, the browser 40, and an image processing module 50C. The image processing module 50C has an image processing unit 52C and the LCD driver 56B. The image processing unit 52C includes the resolution conversion unit 53, an image data correction unit 54C, and the halftoning process unit 55.

Figure 16:
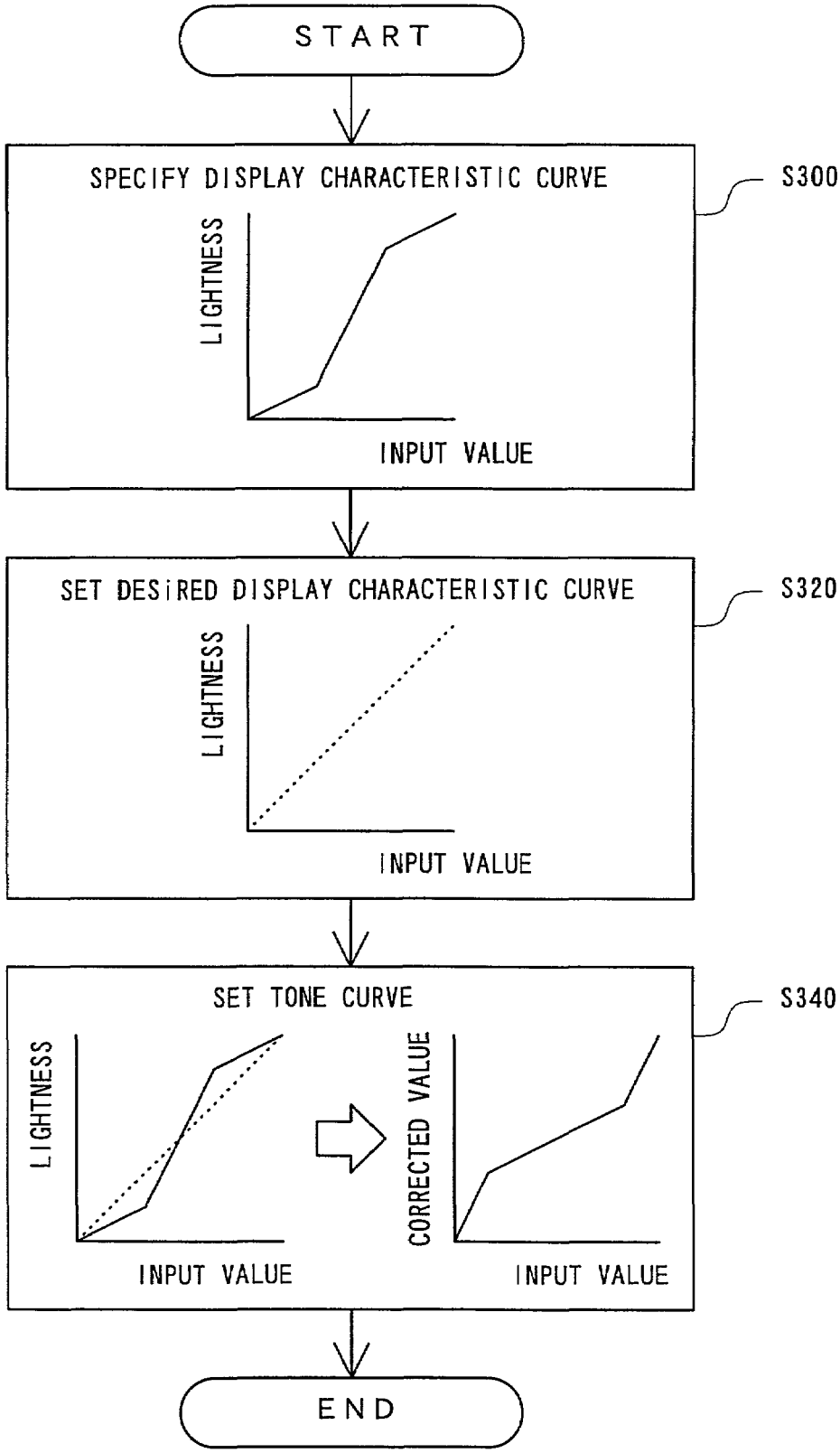
FIG. 16 shows a process of creating the tone curve.

The image data correction unit 54C has the tone value correction data generation unit 54D. The tone value correction data generation unit 54D has the function of creating the tone curve discussed above. FIG. 16 shows a process of creating the tone curve. At first step S300, the process specifies the display characteristics of the color LCD panel 20, which represent the relationship between the input tone value and the output lightness, according to the results of measurement by the temperature sensor 70 and the optical sensor 80 and the setting of the electronic volume 58. A plurality of display characteristic curves corresponding to various combinations of the temperature and the brightness and the setting of the electronic volume are provided in advance and stored in a memory. The concrete procedure of step S300 accordingly selects an adequate one among the plurality of display characteristic curves. The process then reads a desired display characteristic curve, which is also prepared in advance and stored in a memory, at step S320. The desired display characteristic curve may be set arbitrarily. One example is a linear relationship between the input tone value and the output lightness. Another example takes into account the gamma characteristics of the color LCD panel 20. The process subsequently sets the tone curve to compensate for the difference between the specified display characteristic curve and the desired display characteristic curve at step S340. The image data correction unit 54C corrects the tone values of the image data with the tone value correction data thus generated.

The arrangement of the third embodiment does not require a plurality of lookup tables to be stored in advance corresponding to various combinations of the temperature and the brightness, that is, the various working environments of the color LCD panel 20. This effectively saves the storage capacity.

F. Fourth Embodiment

Figure 17:
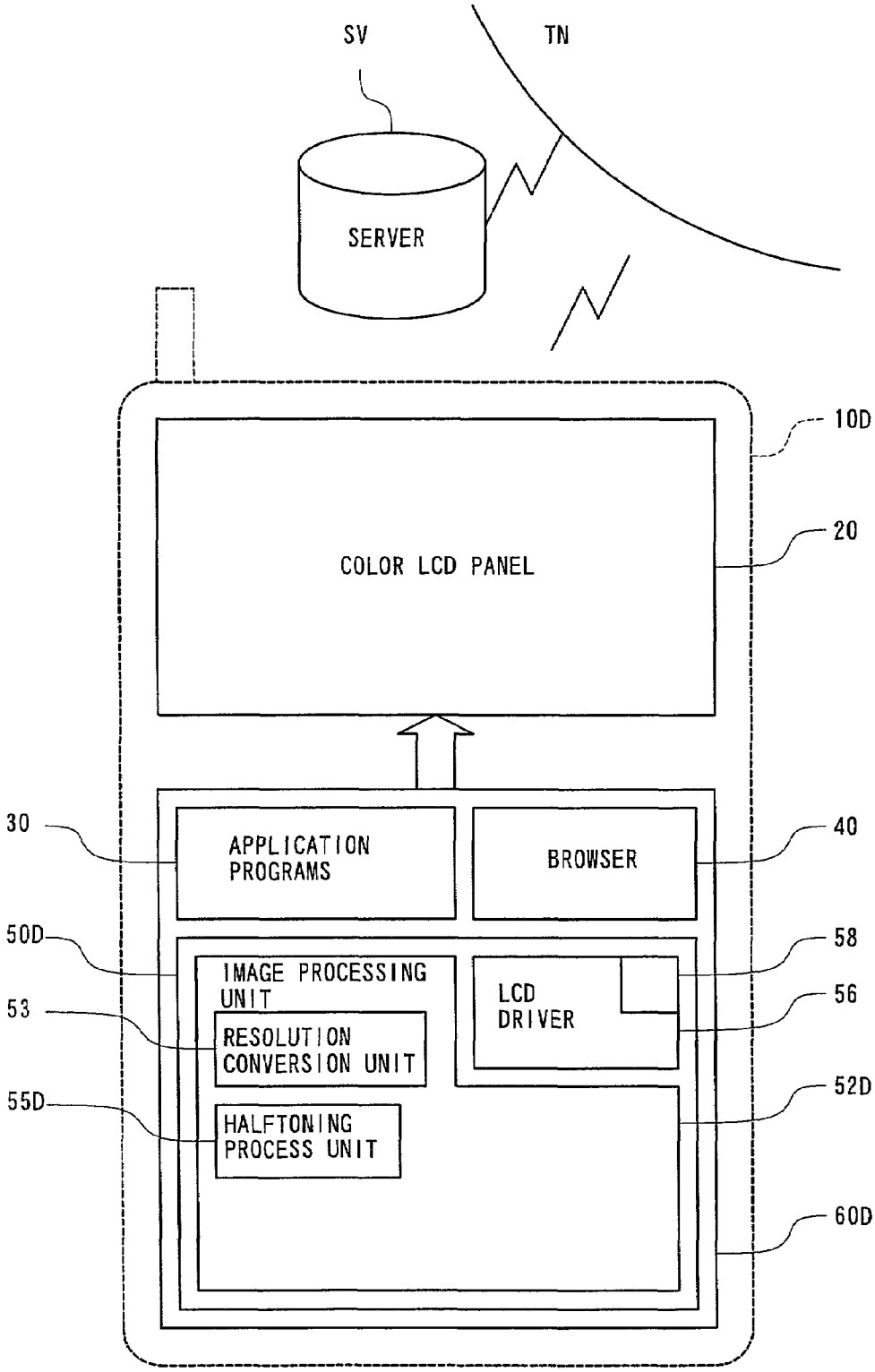
FIG. 17 is a block diagram schematically illustrating the structure of another cellular phone with an image processing apparatus in a fourth embodiment of the present invention.

FIG. 17 is a block diagram schematically illustrating the structure of a cellular phone 10D with an image processing apparatus in a fourth embodiment of the present invention. The constituents of the fourth embodiment other than those discussed below are identical with those of the first embodiment. The cellular phone 10D has the color LCD panel 20 as the image display apparatus and a system unit 60D. The system unit 60D includes the application programs 30, the browser 40, and an image processing module 50D. The image processing module 50D has an image processing unit 52D and the LCD driver 56. The image processing unit 52D includes the resolution conversion unit 53 and a halftoning process unit 55D. The image processing unit 52D of the fourth embodiment does not have the image data correction unit or the tone value correction table for tone correction of the image data.

Figure 18A:
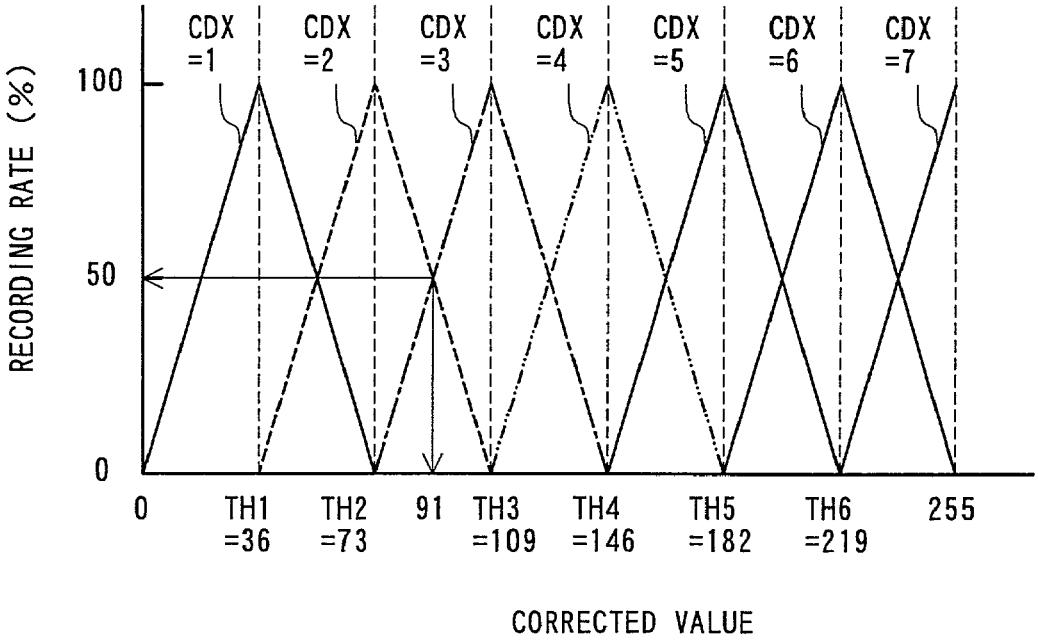
FIGS. 18A and 18B show the relationship between the input value (or the corrected value) and the recording rate of the display tone value CDX.
Figure 18B:
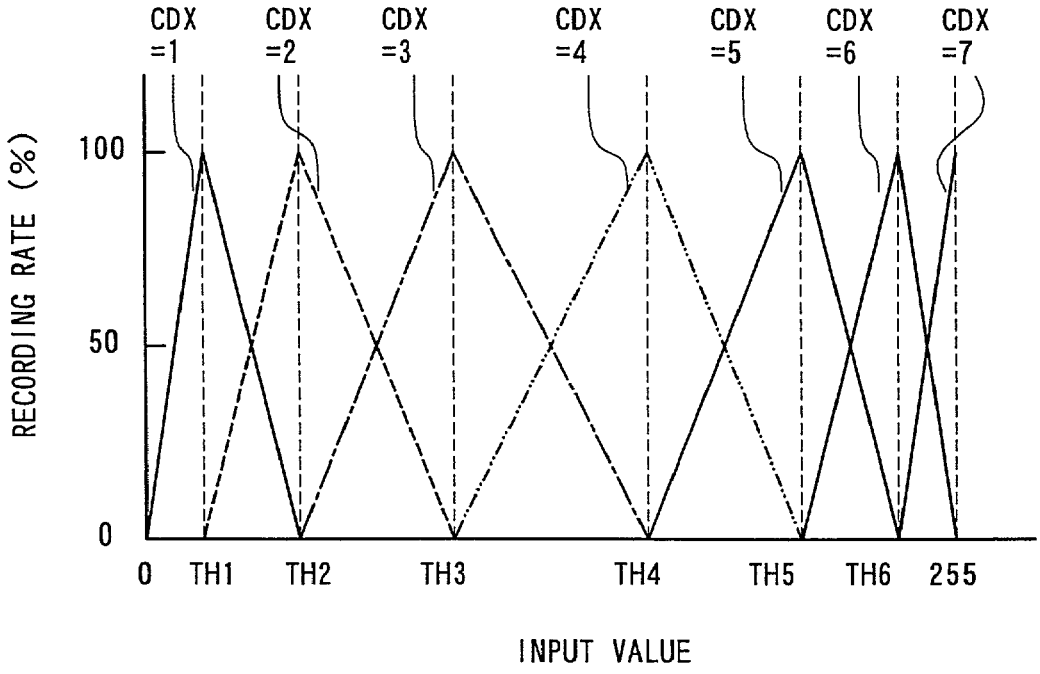

The halftoning process unit 55D carries out the processing discussed below. FIGS. 18A and 18B show the relationship between the input value (or the corrected value) and the recording rate of the display tone value CDX. The graph of FIG. 18A represents the halftoning process executed in the first embodiment, whereas the graph of FIG. 18B represents the halftoning process executed in the fourth embodiment. The recording rate here means a fraction occupied by certain pixels in a solid area continuously filled with a specific tone value. In the graph of FIG. 18A, for example, when the corrected value obtained by tone correction of the tone value in the solid area is equal to 91, pixels having the display tone value CDX=2 and pixels having the display tone value CDX=3 appear in a dispersed manner at a ratio of 50% to 50%. Namely the pixels having the corrected value of 91 are allocated to either the display tone value CDX=2 or CDX=3 with the probability of 50%.

The procedure of the first embodiment sets the threshold values TH1 to TH6, which are used for the halftoning process, at substantially equal intervals as shown in FIG. 18A. The procedure of the fourth embodiment adopts the different settings of the threshold values TH1 to TH6 as shown in FIG. 18B. In the fourth embodiment, the threshold values TH1 to TH6 are set at varying intervals, which are equivalent to the varying intervals of the output lightness against the display tone value CDX. For example, it is assumed that the color LCD panel 20 can output the lightness in the range of 0 to 100. The output lightness is 0, 5, 17, 37, 62, 84, 95, and 100 respectively against the display tone value CDX=0, 1, 2, 3, 4, 5, 6, and 7. The settings of the threshold values TH1 to TH6 are then 13, 43, 94, 158, 214, and 242. It is not necessary that the varying intervals of the threshold values are strictly identical with the varying intervals of the lightness.

In the arrangement of the fourth embodiment, the halftoning process implements the image processing to compensate for the non-linear display characteristics of the color LCD panel 20. This image processing is equivalent to the two-step image processing of the first embodiment, that is, the tone correction and the halftoning process.

One possible modification may carry out the image processing by a combination of the halftoning process unit 55D of the fourth embodiment and the image data correction unit 54 of the first embodiment. In this modified arrangement, the image data correction unit 54 carries out the tone correction to partly compensate for the non-linear display characteristics of the color LCD panel 20. The halftoning process 55D then bears the rest of compensation.

G. Fifth Embodiment

Figure 19:
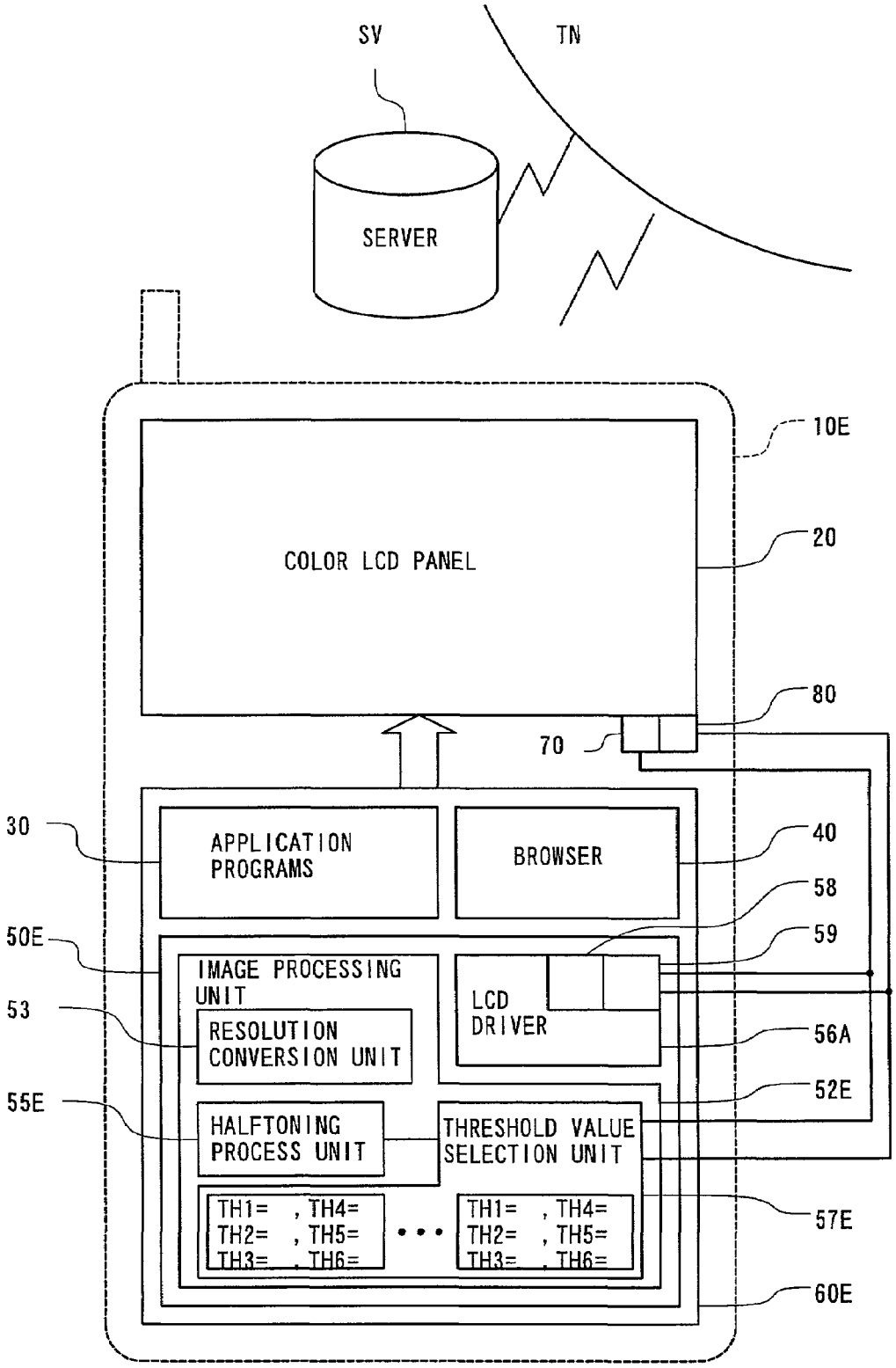
FIG. 19 is a block diagram schematically illustrating the structure of still another cellular phone with an image processing apparatus in a fifth embodiment of the present invention.

FIG. 19 is a block diagram schematically illustrating the structure of a cellular phone 10E with an image processing apparatus in a fifth embodiment of the present invention. The constituents of the fifth embodiment other than those discussed below are identical with those of the second embodiment. The cellular phone 10E has the color LCD panel 20 as the image display apparatus and a system unit 60E. The system unit 60E includes the application programs 30, the browser 40, and an image processing module 50E. The image processing module 50E has an image processing unit 52E and the LCD driver 56A. The image processing unit 52E includes the resolution conversion unit 53, a halftoning process unit 55E, and a threshold value selection unit 57E.

The threshold value selection unit 57E has a plurality of threshold value tables, which are provided corresponding to various working environments (various combinations of the temperature and the brightness) and the setting of the electronic volume 58. The threshold values TH1 to TH6 used for the halftoning process are stored in each threshold value table. The threshold value selection unit 57E selects an optimum threshold value table according to the results of measurement by the temperature sensor 70 and the optical sensor 80. The halftoning process unit 55E carries out the halftoning process based on the selected threshold value table. In the procedures of this embodiment, the threshold value selection unit 57E selects an optimum table among the plurality of threshold value tables. One modified application may set the respective threshold values according to predetermined arithmetic operations.

The arrangement of the fifth embodiment implements the image processing that is equivalent to that performed in the second embodiment.

Any of the image processing apparatuses of the embodiments discussed above has the processing carried out by the computer. Other applications of the present invention thus include computer programs to implement such processing as well as recording media in which the computer programs are recorded. The recording medium may include the tone curve that is recorded therein as the tone value correction table and is used for the image processing executed in the first embodiment or the second embodiment. Typical examples of the recording medium include flexible disks, CD-ROMs, magneto-optic discs, IC cards, ROM cartridges, punched cards, prints with barcodes or other codes printed thereon, internal storage devices (memories like a RAM and a ROM) and external storage devices of the computer, and a variety of other computer readable media.

H. Modifications

The present invention is not restricted to the above embodiments or their modifications, but there may be many other modifications, changes, and alterations without departing from the scope or spirit of the main characteristics of the present invention. Some examples of possible modification are given below.

H1. Modification 1

The above embodiments regard the application of the present invention for the cellular phone, but the present invention is not restricted to such application. For example, the principle of the present invention is applicable to mobile information terminals and a diversity of electronic apparatuses with a liquid crystal display apparatus for displaying images, such as car navigation systems.

H2. Modification 2

In the above embodiments, the image display apparatus has the color LCD panel of passive matrix actuation. In general, the present invention is applicable to any liquid crystal display apparatus that has a less number of expressible tones than the number of tones included in original image data. One possible application of the present invention is a color LCD panel of active matrix actuation using a TFT (thin film transistor) or TFD (thin film diode). The color LCD panel of frame rate control-type actuation used in the above embodiments may be replaced with another color LCD panel of pulse width modulation-type actuation.

Although the technique of the present invention is especially effective for the non-linear relationship between the input tone value and the display tone value, it is also applicable to linear display characteristics. In the latter case, tone correction according to each linear display characteristic improves the picture quality of the resulting displayed image. The display characteristics to be considered here include the general bias of lightness, an increase in lightness with an increase in display tone value, and the number of expressible tones.

H3. Modification 3

The above embodiments regard the application of the present invention for the liquid crystal display apparatus of voltage actuation and control. The present invention is also applicable to another liquid crystal display apparatus of electric current actuation and control and a diversity of other image display apparatuses that enable multiple tone expression of images by regulating any driving signal.

H4. Modification 4

In the above embodiments, the input image data file follows the GIF of the 8-bit color table. The input image data may, however, follow another format, for example, JPEG of the 24-bit RGB colors.

H5. Modification 5

The procedures of the first through the third embodiments carry out the halftoning process, but the halftoning process may be omitted from the series of the processing.

H6. Modification 6

The arrangement of the second embodiment specifies the tone value correction table and the setting of the electronic volume according to the temperature and the brightness of the environment, in which the color LCD panel is used. The specification may alternatively depend upon either one of the environmental temperature and brightness. Lookup tables corresponding to various combinations of the temperature and the brightness of the environment, in which the color LCD panel is used, may be provided separately from lookup tables corresponding to the settings of the electronic value. In this case, the tone correction may have two steps using the respective tables. The specification may also depend upon the brightness and the on-off state of the backlight of the color LCD panel.

H7. Modification 7

In the above embodiments, the cellular phone has both the image display apparatus and the image processing apparatus. The image processing apparatus may alternatively be independent of the image display apparatus. The server SV that stores image data may be provided with part or the whole of the image processing apparatus of the present invention. For example, in the process of transmittance of image data to the cellular phone, the server SV may carry out the series of image processing up to the tone correction, whereas the cellular phone carries out the halftoning process. In another example, the server SV may carry out the series of image processing up to the halftoning process. The server SV may perform such processing in the course of storing the uploaded image data.

The user's computer or any other equivalent may also be provided with part or the whole of the image processing apparatus of the present invention. The user's computer may perform the series of image processing up to the tone correction or up to the halftoning process, prior to upload of image data to the server SV.

This application specifies the display characteristic of an image display apparatus of interest (in this embodiment, this corresponds to the model of the cellular phone) and corrects the image data according to the specified display characteristic to improve the picture quality of resulting displayed images.

What is claimed is:

1. An image processing apparatus that carries out predetermined image processing of image data, which are to be displayed on an image display apparatus apparatus, and thereby generates supplied data to the image display apparatus, the image display apparatus being a liquid crystal display apparatus that provides frame rate control-type tone display and has a less number of expressible display tones with regard to each pixel than a number of tones in the image data, the image processing apparatus comprising: an input unit that inputs the image data; and a color reduction process unit that sets a display tone value, which is expressible by the liquid crystal display apparatus, with regard to each pixel, based on tone values of the image data, wherein a range of the tone values allocated to each display tone value in at least either one of a high tone region and a low tone region by the color reduction process unit is narrower than that in an intermediate tone region.

2. An image processing apparatus in accordance with claim 1, wherein the color reduction process unit carries out a dispersion-type halftoning process.

3. An image processing apparatus in accordance with claim 1 further comprises an image data correction unit that carries out the correction that reduces a tone distribution in the intermediate tone region while enhancing tone distributions in both the low tone region and the high tone region.

4. An image processing apparatus in accordance with claim 1 further comprises:

storage means that stores therein a mapping of tone values of the input image data and corrected tone values, and an image data correction unit that refers to the storage means and corrects the tone values.

5. An image processing apparatus that carries out predetermined image processing of image data, which are to be displayed on an image display apparatus, and thereby generates supplied data to the image display apparatus, the image display apparatus having a less number of expressible display tones with regard to each pixel than a number of tones included in the image data, giving output lightness that varies stepwise against display tone value, and having a non-linear display characteristic that provides the output lightness at varying intervals, the image processing apparatus comprising:

an image data correction unit that carries out tone correction by taking into account the non-linear display characteristic to enhance a tone distribution corresponding to an area of wide intervals, while reducing a tone distribution corresponding to an area of narrow intervals in a tone distribution of input image data; and a color reduction process unit that divides a range of the tone correction into a preset number of divisions and allocates tone corrected values in each division to each display tone value according to a predetermined rule, so as to implement color reduction.

6. An image processing apparatus in accordance with claim 5, wherein the preset number of divisions is obtained by dividing the range of the tone, correction into substantially equal parts.

7. An image processing apparatus in accordance with claim 5, wherein the color reduction process unit carries out a dispersion-type halftoning process.

8. An image processing apparatus in accordance with claim 7, wherein the color reduction process unit carries out the dispersion-type halftoning process only when the image data is a specified type.

9. An image processing apparatus in accordance with claim 5, wherein, the image display apparatus is a liquid crystal display apparatus applied for a cellular phone and implements frame rate control-type tone display.

10. An image processing apparatus in accordance with claim 5, wherein the image data correction unit carries out the tone correction that reduces a tone distribution in an intermediate tone region while enhancing tone distributions in both a low tone region and a high tone region.

11. An image processing apparatus in accordance with claim 5, the image processing apparatus further comprising:

storage means that stores therein a mapping of tone values of the input image data and corrected tone values, the image correction unit refers to the storage means to correct the tone values.

12. An image processing apparatus in accordance with claim 11, the image processing apparatus comprising:

a plurality of the storage means are provided corresponding to a plurality of settings for a predetermined condition, the predetermined condition affecting the display characteristic of the image display apparatus; and a storage means selection unit that selects one among the plurality of storage means, based on an input setting for the predetermined condition.

13. An image processing apparatus in accordance with claim 12, wherein the predetermined condition is temperature around the image display apparatus.

14. An image processing apparatus in accordance with claim 12, wherein the predetermined condition is brightness around the image display apparatus.

15. An image processing apparatus in accordance with claim 12, wherein the image display apparatus is a liquid crystal display apparatus with a backlight, and the predetermined condition is brightness of the backlight.

16. An image processing apparatus in accordance with claim 12, wherein the predetermined condition is a setting of a contrast adjuster that adjusts display contrast of the image display apparatus.

17. An image processing apparatus that carries out predetermined image processing of image data, which are to be displayed on an image display apparatus, and thereby generates supplied data to the image display apparatus, the image display apparatus having a less number of expressible display tones with regard to each pixel than a number of tones included in the image data, giving output lightness that varies stepwise against display tone value, and having a non-linear display characteristic that provides the output lightness at varying intervals, the image processing apparatus comprising:

a color reduction process unit that divides a range of tone values of the image data into plural divisions of varying widths corresponding to the non-linear display characteristic and allocates tone values in each division to each display tone value according to a predetermined rule, so as to implement color reduction.

18. An image processing apparatus in accordance with claim 17, wherein the color reduction process unit carries out a dispersion-type halftoning process.

19. An image processing apparatus in accordance with claim 18, wherein the color reduction process unit carries out the dispersion-type halftoning process only when the image data is a specified type.

20. An image processing apparatus in accordance with claim 17, wherein the image display apparatus is a liquid crystal display apparatus applied for a cellular phone and implements frame rate control-type tone display.

21. An image processing method that carries out predetermined image processing of image data, which are to be displayed on a liquid crystal display apparatus, and thereby generates data that are supplied to the liquid crystal display apparatus, the liquid crystal display apparatus providing frame rate control-type tone display and having a less number of expressible display tones with regard to each pixel than a number of tones in the image data, the image processing method comprising the steps of:

(a) specifying a display characteristic of the liquid crystal display apparatus of interest; and (b) setting a display tone value, which is expressible by the liquid crystal display apparatus, with regard to each pixel, based on tone values of the image data, so that a range of the tone values allocated to each display tone value in at least either one of a high tone region and a low tone region is narrower than that in an intermediate tone region.

22. An image processing method that carries out predetermined image processing of image data, which are to be displayed on an image display apparatus, and thereby generates supplying data to the image display apparatus, the image display apparatus having a less number of expressible display tones with regard to each pixel than a number of tones included in the image data, giving output lightness that varies stepwise against display tone value, and having a non-linear display characteristic that provides the output lightness at varying intervals, the image processing method comprising the steps of:

(a) specifying a display characteristic of the image display apparatus of interest;

(b) carrying out tone correction by taking into account the non-linear display characteristic to enhance a tone distribution corresponding to an area of wide intervals, while reducing a tone distribution corresponding to an area of narrow intervals in a tone distribution of input image data; and (c) dividing a range of the tone correction into a preset number of divisions and allocating tone corrected values in each division to each display tone value according to a predetermined rule, so as to implement color reduction.

23. An image processing method that carries out predetermined image processing of image data, which are to be displayed on an image display apparatus, and thereby generates supplied data to the image display apparatus, the image display apparatus having a less number of expressible display tones with regard to each pixel than a number of tones included in the image data, giving output lightness that varies stepwise against display tone value, and having a non-linear display characteristic that provides the output lightness at varying intervals, the image processing method comprising the steps of:

(a) specifying a display characteristic of the image display apparatus of interest; and (b) dividing a range of tone values of the image data into plural divisions of varying widths corresponding to the non-linear display characteristic and allocating tone values in each division to each display tone value according to a predetermined rule, so as to implement color reduction.

24. A computer program product that comprises a computer program carrying out predetermined image processing of image data, which are to be displayed on a liquid crystal display apparatus, the liquid crystal display apparatus providing frame rate control-type tone display and having a less number of expressible display tones with regard to each pixel than a number of tones in the image data, the computer program causing a computer to attain the functions of:

specifying a display characteristic of the liquid crystal display apparatus of interest; and setting a display tone value, which is expressible by the liquid crystal display apparatus, with regard to each pixel, based on tone values of the image data, so that a range of the tone values allocated to each display tone value in at least either one of a high tone region and a low tone region is narrower than that in an intermediate tone region.

25. A computer program product that comprises a computer program carrying out predetermined image processing of image data, which are to be displayed on an image display apparatus, the image display apparatus having a less number of expressible display tones with regard to each pixel than a number of tones included in the image data, giving output lightness that varies stepwise against display tone value, and having a non-linear display characteristic that provides the output lightness at varying intervals, the computer program causing a computer to attain the functions of:

specifying a display characteristic of the image display apparatus of interest;

carrying out tone correction by taking into account the non-linear display characteristic to enhance a tone distribution corresponding to an area of wide intervals, while reducing a tone distribution corresponding to an area of narrow intervals in a tone distribution of input image data; and dividing a range of the tone correction into a preset number of divisions and allocating tone corrected values in each division to each display tone value according to a predetermined rule, so as to implement color reduction.

26. A computer program product that comprises a computer program carrying out predetermined image processing of image data, which are to be displayed on an image display apparatus, the image display apparatus having a less number of expressible display tones with regard to each pixel than a number of tones included in the image data, giving output lightness that varies stepwise against display tone value, and having a non-linear display characteristic that provides the output lightness at varying intervals, the computer program causing a computer to attain the functions of:

specifying a display characteristic of the image display apparatus of interest; and dividing a range of tone values of the image data into plural divisions of varying widths corresponding to the non-linear display characteristic and allocating tone values in each division to each display tone value according to a predetermined rule, so as to implement color reduction.

* * * * *